US008638966B2

(12) United States Patent
Taylor et al.

(10) Patent No.: US 8,638,966 B2
(45) Date of Patent: Jan. 28, 2014

(54) HAPTIC CHAIR SOUND ENHANCING SYSTEM WITH AUDIOVISUAL DISPLAY

(75) Inventors: Oh Elizabeth Ann Taylor, Singapore (SG); Suranga Chandima Nanayakkara, Singapore (SG); Lonce Lamar Wyse, Singapore (SG); Sim Heng Ong, Singapore (SG); Kian Peen Yeo, Singapore (SG); Ghim Hui Tan, Singapore (SG)

(73) Assignee: National University of Singapore, Singapore (SG)

( * ) Notice: Subject to any disclaimer, the term of this patent is extended or adjusted under 35 U.S.C. 154(b) by 138 days.

(21) Appl. No.: 13/061,838

(22) PCT Filed: Sep. 18, 2009

(86) PCT No.: PCT/SG2009/000349

§ 371 (c)(1),
(2), (4) Date: Jun. 1, 2011

(87) PCT Pub. No.: WO2010/033086

PCT Pub. Date: Mar. 25, 2010

(65) Prior Publication Data

US 2011/0228962 A1 Sep. 22, 2011

Related U.S. Application Data

(60) Provisional application No. 61/098,293, filed on Sep. 19, 2008, provisional application No. 61/098,294, filed on Sep. 19, 2008.

(51) Int. Cl.
*H04R 25/00* (2006.01)

(52) U.S. Cl.
USPC ..... 381/333; 381/301; 381/388

(58) Field of Classification Search
USPC ..... 381/300, 301, 306, 310, 332–335, 388
See application file for complete search history.

(56) References Cited

U.S. PATENT DOCUMENTS

| | | | | |
|---|---|---|---|---|
| 2,858,376 | A | 10/1958 | Lewis | |
| 3,423,544 | A | 1/1969 | Weiss | |
| 4,023,566 | A * | 5/1977 | Martinmaas | 381/388 |
| 5,368,359 | A | 11/1994 | Eakin | |
| 5,553,148 | A * | 9/1996 | Werle | 381/151 |
| 6,075,868 | A * | 6/2000 | Goldfarb et al. | 381/388 |
| 6,369,312 | B1 | 4/2002 | Komatsu | |
| 7,402,922 | B2 * | 7/2008 | Springer et al. | 381/396 |

OTHER PUBLICATIONS

International Search Report and Written Opinion of PCT/SG2009/000349 dated Dec. 9, 2009.

* cited by examiner

*Primary Examiner* — Suhan Ni
(74) *Attorney, Agent, or Firm* — Hamilton, Brook, Smith & Reynolds, P.C.

(57) ABSTRACT

A sound enhancing system includes a haptic chair formed of a chair and plural speakers mounted to the chair. The speakers receive audio input from a subject audio source and generate corresponding sound vibrations. The chair is configured to deliver the generated sound vibrations to various body parts of a user seated in the chair through the sense of touch and by bone conduction of sound. A visual display viewable by the user corresponds to the generated sound vibrations and is indicative of the corresponding audio input. The sound enhancing system enhances user experience of the audio input by any one or combination of visually, by the sense of touch, and by bone conduction of sound.

21 Claims, 12 Drawing Sheets

OVERALL FSS SCORE FOR ALL EXPERIMENTAL CONDITIONS

PLOT OF FSS SCORE WITH 95% CONFIDENCE INTERVAL (CI) FOR FOUR DIFFERENT COMBINATIONS

OVERALL FSS SCORE FOR ALL EXPERIMENTAL CONDITIONS,

PLOT OF MEAN FSS SCORE WITH 95% CONFIDENCE INTERVAL (CI) FOR THREE DIFFERENT COMBINATIONS (A - 2D ABSTRACT PATTERNS, B - 2D ABSTRACT PATTERNS, C - HUMAN GESTURES)

OVERALL FSS SCORE FOR ALL EXPERIMENTAL CONDITIONS

PLOT OF MEAN FSS SCORE WITH 95% CONFIDENCE INTERVAL (CI) FOR THREE DIFFERENT COMBINATIONS (A - NO VISUALS, B - MUSIC WITH SYNCHRONISED GESTURES, C - MUSIC WITH ASYNCHRONISED GESTURES)

MEAN USE SCORE OF SATISFACTION MONITORED FROM
SIX PARTICIPANTS OVER A PERIOD OF THREE WEEKS.
(BARS AT EACH DATA POINT SHOWS THE 95% CONFIDENCE INTERVALS)

HAPTIC CHAIR SOUND ENHANCING SYSTEM WITH AUDIOVISUAL DISPLAY

RELATED APPLICATIONS

This application is the U.S. National Stage of International Application No. PCT/SG2009/000349, filed Sep. 18, 2009, which designates the U.S., published in English, and claims the benefit of U.S. Provisional Application No. 61/098,293, filed Sep. 19, 2008 and U.S. Provisional Application No. 61/098,294, filed Sep. 19, 2008. The entire teachings of the above applications are incorporated herein by reference.

BACKGROUND OF THE INVENTION

Consider the kinds of musical behaviours that typical non-musically trained listeners with normal hearing engage in as part of everyday life. Such listeners can tap their foot or otherwise move rhythmically in response to a musical stimulus. They can quickly articulate whether the piece of music is in a familiar style, and whether it is a style they like. If they are familiar with the music, they might be able to identify the composer and/or performers. The listeners can list instruments they hear playing. They can immediately assess stylistic and emotional aspects of the music, including whether or not it is loud, complicated, sad, fast, soothing, or generates a feeling of anxiety. They can also make complicated socio-cultural judgments, such as suggesting a friend who would like the music, or a social occasion for which it is appropriate.

Now, if the listeners are hearing-impaired, what would their musical behaviour be? Partial or profound lack of hearing makes the other ways humans use to sense sound in the environment much more important for the deaf than for people with normal hearing. Sound transmitted through the air and through other physical media such as floors, walls, chairs and machines act on the entire human body, not just the ears, and play an important role in the perception of music and environmental aspects for all people, but in particular for the deaf. In fact, it has been found that some deaf people process vibrations sensed via touch in the part of the brain used by other people for hearing. See D. Shibata "Brains of Deaf People 'Hear' Music" in International Arts-Medicine Association Newsletter, 16, 4 (2001). This provides one possible explanation for how deaf musicians can sense music, and how deaf people can enjoy concerts and other musical events.

These findings may suggest that a mechanism to physically 'feel' music might provide an experience to a hearing impaired person that is qualitatively similar to the experience a normal hearing person has while listening to music. However, little research has specifically addressed the question of how to optimize a musical experience for a deaf person.

Some previous work has been done on providing awareness of environmental sounds to deaf people. (See F. W. Ho-Ching, et al., "Can you see what I hear? The Design and Evaluation of a Peripheral Sound Display for the Deaf," in Proceedings of the SIGCHI (Conference on Human Factors in Computing Systems 2003), ACM Press (2003), pgs. 161-168; and T. Matthews, et al., "Visualizing Non-Speech Sounds for the Deaf," in Proceedings of ASSETS (Proceedings of the 7$^{th}$ International ACM SIGACCESS Conference on Computers and Accessibility 2005), ACM Press (2005), pgs. 52-59.) However, no guidance is available to address the challenges encountered at the early stage of designing a system for the deaf to facilitate a better appreciation of music.

Music and the Deaf

Profoundly deaf musicians and those with less pronounced hearing problems have clearly demonstrated that deafness is not a barrier to musical participation and creativity. Dame Evelyn Glennie is a world renowned percussionist who has been profoundly deaf since the age of 12 years but 'feels' the pitch of her concert drums and xylophone, and the flow of a piece of music through different parts of her body—from fingertips to feet. Other examples include profoundly deaf musicians such as Shawn Dale—the first and only person born completely deaf who achieved a top ten hit on Music Television (MTV) in 1987; and Beethoven, the German composer who gradually lost his hearing in mid-life but who continued to compose music by increasingly concentrating on feeling vibrations from his piano forte.

Visualising Music

The visual representation of music has a long and colourful history. In the early 20$^{th}$ century Oskar Fischinger, an animator, created exquisite 'visual music' using geometric patterns and shapes choreographed tightly to classical music and jazz. Walt Disney, in 1940, released a movie called 'Fantasia' where animation without any dialogue was used to visualise classical music. Another example is Norman McLaren, a Canadian animator and film director who created 'animated sound' by hand-drawn interpretations of music for film. (See R. Jones and B. Nevile, "Creating Visual Music in Jitter: Approaches and Techniques," in Computer Music Journal, 29, 4 (2005) pgs. 55-70.) Among the earliest researchers to use a computer based approach was J. B. Mitroo who in 1979 input musical attributes such as pitch, notes, chords, velocity, loudness, etc., to create colour compositions and moving objects. (See J. B. Mitroo, et al., "Movies from Music: Visualizing Musical Compositions," in Proceedings of SIGGRAPH 1979 (International Conference on Computer Graphics and Interactive Techniques), ACM Press (1979), pgs. 218-225.) Since then, music visualisation schemes have proliferated to include commercial products like WinAmp® and iTunes®, as well as visualizations to help train singers. It is not the purpose of this work to discuss full history here. B. Evans in "Foundations of a Visual Music," Computer Music Journal, 29, 4 (2005), pgs. 11-24 gives a review of visual music. However, the effect of these different music visualizations on the hearing impaired has not been scientifically investigated and no prior specific application for this purpose is known to Applicants.

Feeling Music

As mentioned above, feeling sound vibrations through different parts of the body plays an important role in perceiving music, particularly for the deaf. Based on this concept, R. Palmer, in 1994, developed a portable music floor which he called Tac-Tile Sounds Systems (TTSS). However, Applicants have not been able to find a report of any formal objective evaluation of the TTSS. Recently, Kerwin developed a touch pad that enables deaf people to feel music through vibrations sensed by the fingertips. (See "Can you feel it? Speaker Allows Deaf Musicians to Feel Music," Brunel University Press Release, October 2005.) The author claimed that, when music is played, each of the five finger pads on a device designed for one hand vibrates in a different manner and this enables the wearer to feel the difference between notes, rhythms and instrument combinations. As in the previously cited TTSS by Palmer, not many technical or user test details about this device are available. M. Karam, et al., developed an EmotiChair which transforms an audio signal into discrete vibro-tactile output channels using a Model Human Cochlea (MHC), and these output channels are presented in a logical progression along the back of the body. (See M. Karam, et al., "Modelling Perceptual Elements of Music in a Vibrotactile Display for Deaf Users: A Field Study," in Proceedings of ACHI, 2009 (Second International Conferences on Advances in Computer-Human Interactions, 2009), pp 249-254; and M. Karam, et al., "Towards a Model Human Cochlea: Sensory Substitution for Crossmodal Audio-Tactile Displays," in Proceedings of Graphics Interface 2008, Windsor, Ontario, Canada, May 28-30, 2008, pgs. 267-274.) Gunther, et al., introduced the concept of 'tactile composition' based on a similar system comprised of thirteen transducers worn against the body with the aim of creating music specifically for tactile display. (See E. Gunther, et al., "Cutaneous Grooves: Composing for the Sense of Touch," in Proceedings of 2002 Conference on New Instruments for Musical Expression (NIME-02), Dublin, Ireland, May 24-26, 2002, pgs. 1-6.)

The closest commercially available comparisons to Applicants' proposed invention include the 'Vibrating Bodily Sensation Device' from Kunyoong IBC Co, the 'X-chair' by Ogawa World Berhad, the 'Multisensory Sound Lag' (MSL) from Oval Window Audio, and Snoezelen® vibromusic products from Flaghouse, Inc. These devices are designed to process sound, including music inputs according to pre-defined transformations before producing haptic output. The Kunyoong IBC Co's Vibrating Bodily Sensation Device only stimulates the one part of the body (the lower lumbar region of the body which is more sensitive to lower frequencies).

SUMMARY OF THE INVENTION

Applicants address the foregoing problems and shortcomings of the prior art and provide a system which has three main music-driven components: (i) a 'Haptic Chair' that vibrates with the music providing tactile information via the sense of touch; (ii) bone conduction of sound; and (iii) a computer display of informative visual effects. The computer display generates different visual effects based on musical features such as note onsets, pitch, amplitude, timbre, rhythm, beats and key changes. The bone conduction of sound may include amplitude modulated ultrasonic carrier signals. The three components may be used in any combination or independently of each other, corresponding in real-time to features of the music. In preferred embodiments, the haptic chair provides to the user input via both the sense of touch and bone conduction of sound.

The present invention system is different from most of the prior described because Applicants do not electronically preprocess the natural vibrations produced by music. Because people sense musically derived vibrations throughout the body when experiencing music, any additional or deliberately altered 'information' delivered through this channel might disrupt the musical experience and this confounding effect is potentially more significant for the deaf. Since the human central nervous system (CNS) is particularly plastic in its intake of various sensory inputs and production of often different sensory output, it is important to support this ability to create new sensory experiences for people with specific impairments. The human CNS is still largely a 'black box' in data processing terms and it would be unforgivable to assume one can create a computerized system to replace its many and various abilities. Therefore, Applicants decided not to alter the natural vibrations caused by musical sounds (audio stimuli), but to design the invention Haptic Chair to simply amplify the natural vibrations produced by subject music and give the user of the system the freedom to acquire the input he finds most beneficial. Preliminary testing suggested that the Haptic Chair was capable of providing, not only haptic sensory input (via the sense of touch) but also bone conduction of sound via ear or directly to the CNS. This does not exclude specific amplification or attenuation of the sound spectrum.

Sound enhancing devices and methods embodying the present invention include: a chair and one or more speakers coupled to the chair. The speakers receive audio input from an audio source and generate corresponding sound vibrations. The speakers are coupled to the chair in a manner delivering the generated vibrations to body parts of the user seated in the chair (through sense of touch) and delivering sound to the user by bone conduction. Such delivery enhances user experience of the subject audio (e.g., music, real-time stream, recorded stream of audio data, speech, other environmental sounds and the like). A visual display corresponds to the audio input and includes any combination of text, color-based indications of respective features of the audio input, and variance in visual brightness as a function of amplitude of the audio input. In other embodiments, the visual display includes three dimensional patterns and/or human gestures.

Embodiments of the present invention enhance music (audio) experiences for both hearing-impaired and normal hearing people. At various stages of development, Applicants had informal discussions with more than 15 normal hearing people who tried the Haptic Chair and received positive feedback.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Music is a multi-dimensional experience informed by much more than hearing alone and is thus accessible to people of all hearing abilities. Applicants present a method and system designed to enrich the experience of music, primarily for the deaf but also by people of normal hearing abilities, by enhancing sensory input of information via channels other than in air audio reception by the ear. The method and system has three main music-driven components: a haptic chair 31 which provides tactile information via the sense of touch; bone conduction of sound including amplitude modulated ultrasonic carrier signals; and a computer display of informative visual effects that correspond to features of the music. These components may be used independently of each other or in various combinations that correspond in real-time to features of the music. The haptic chair provides input both via the sense of touch and also bone conduction of sound. The present invention system was developed based on information obtained from a background survey conducted with deaf people of multi-ethnic backgrounds, and musically detailed feedback received from two deaf musicians during informal interviews.

Figure 2A:
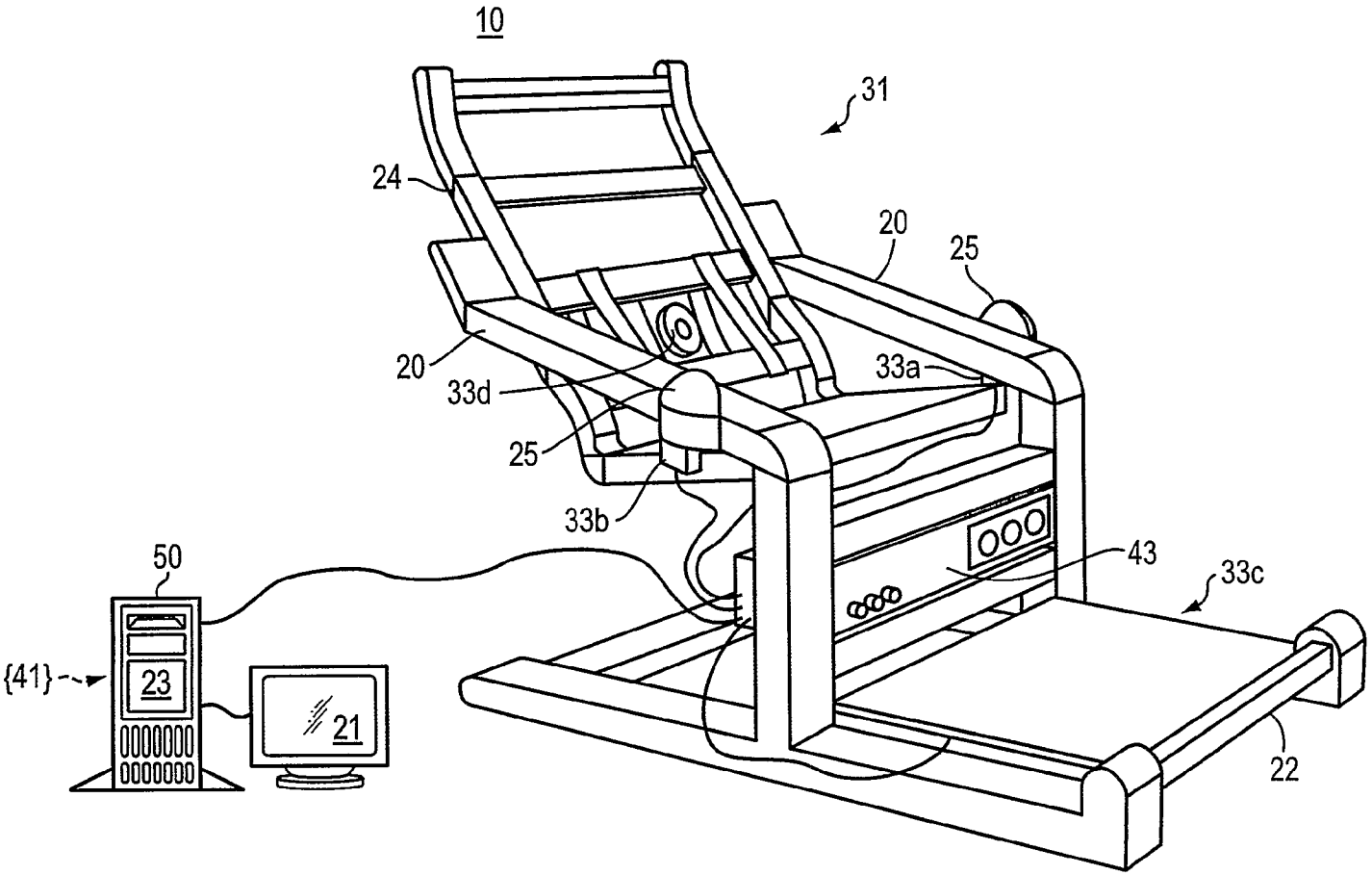
FIGS. 2*a*-2*c* are schematic views of embodiments of the present invention formed of a haptic chair and visual display.

One embodiment (sound enhancing system 10) is illustrated in FIG. 2*a* and includes haptic chair 31 and visual display 21. The Haptic chair 31 has multiple contact speakers 33*a,b,c,d* (generally referred to as speakers 33) positioned at various locations for delivering sound vibration to the listener-user seated in the chair 31. In particular, the contact speakers 33 are positioned to deliver sound-generated vibration to the fingertips, palms of hand, elbow, lower/middle back (especially along the spinal cord), upper chest and feet, for example. Applicants' prior study found these body areas to be especially sensitive to vibrations.

In FIG. 2*a*, one speaker 33*a,b* each is located at the distal end of arm rest 20 particularly aimed at delivering vibrations through the sense of touch to the listener-user's hand area (e.g., fingertips and palms). In another embodiment shown in FIGS. 2*b*-2*c*, speakers 33*a,b* may be positioned at the proximal end of arm rest 20 aimed toward the listener-user's elbow area. Different embodiments employ different numbers and types of speakers from flat panel speakers 29 in FIGS. 2*b*-2*c* to contact speakers 33 in FIG. 2*a* (as will be made clearer later). The flat panel speakers 29*a, b* (generally referenced 29) may have a textured upper surface 30 in one embodiment and smooth upper surface 30 in another embodiment. Common methods and means (including materials) for providing texture to surfaces 30 are employed. Further in one embodiment, an audio power amplification and control unit 43 includes adjustable controls enabling the user to control the intensity of the vibrations of the speakers 29, 33.

The visual display 21 may be a laptop or other computer monitor, TV display monitor, other output display and the like coupled to a digital processing system 50. The processor/computer system 50 synchronizes the video display 21 and chair 31 sound vibrations. In particular, a visualizer subsystem 23 drives the visual display 21 according to the audio source 41 that is used to generate the sound vibrations of the chair 31. Further details of the chair 31 and visual display 21 (i.e. visualizer subsystem 23) are presented below.

Figure 2B:
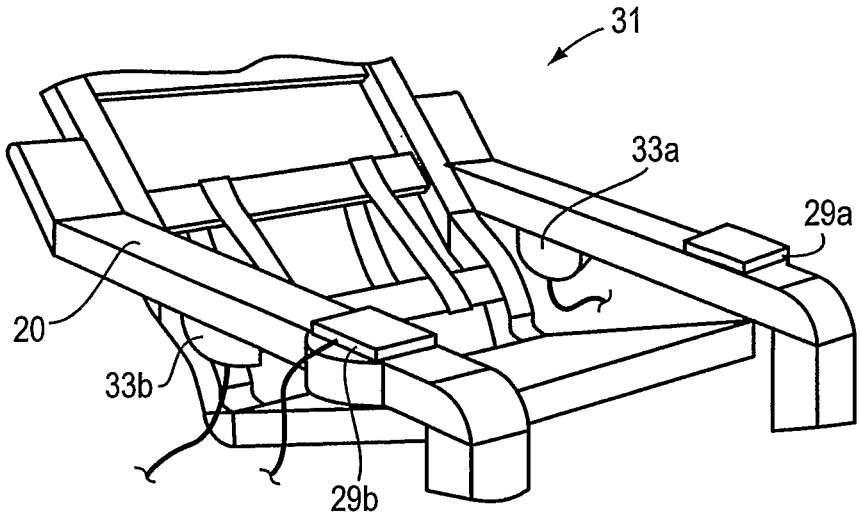
Figure 2C:
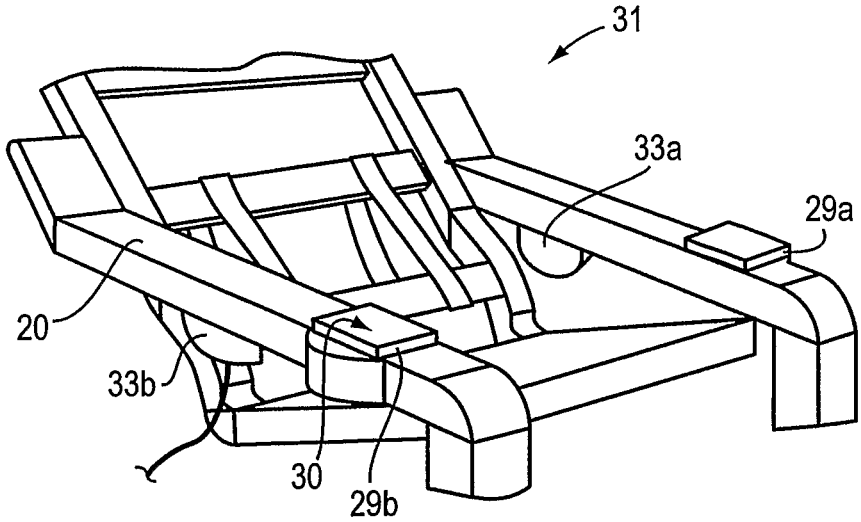
Figure 3:
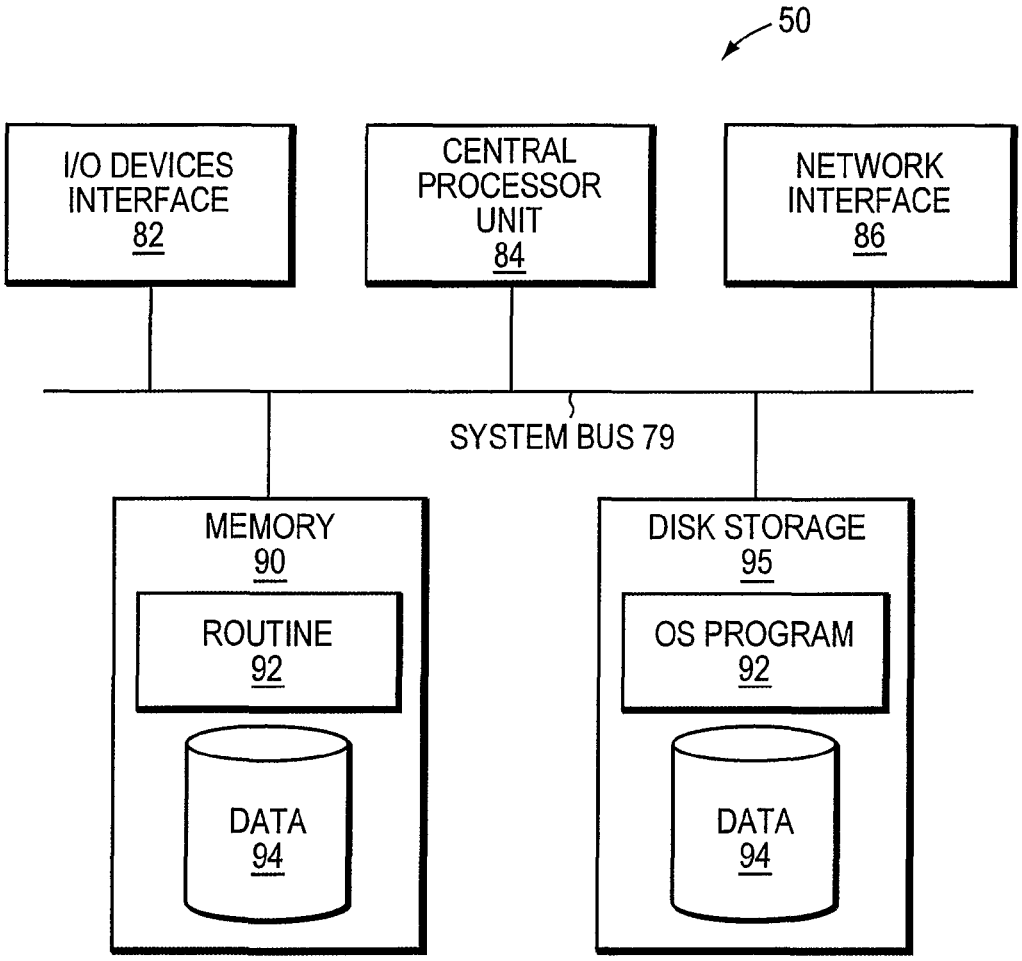
FIG. 3 is a block diagram of a computer processor system employed in the embodiments of FIGS. 2*a*-2*c*.

FIG. 3 is a diagram of the internal structure of the computer (e.g., client processor/device) 50 in embodiments of the sound enhancing system 10 of FIGS. 2*a*-2*c*. The computer 50 contains system bus 79, where a bus is a set of hardware lines used for data transfer among the components of a computer or processing system. Bus 79 is essentially a shared conduit that connects different elements of a computer system (e.g., processor, disk storage, memory, input/output ports, network ports, etc.) that enables the transfer of information between the elements. Attached to system bus 79 is I/O device interface 82 for connecting various input and output devices (e.g., keyboard, mouse, displays, printers, speakers, etc.) to the computer 50. Network interface 86 allows the computer to connect to various other devices attached to a network (e.g., local area network, wide area network, global computer network, and so on). Memory 90 provides volatile storage for computer software instructions 92 and data 94 used to implement an embodiment/system 10 of the present invention (e.g., visualizer 23, sound subsystem 35, and supporting code further described below). Disk storage 95 provides non-volatile storage for computer software instructions 92 and data 94 used to implement an embodiment of the present invention. Central processor unit 84 is also attached to system bus 79 and provides for the execution of computer instructions.

In one embodiment, the processor routines 92 and data 94 are a computer program product (generally referenced 92), including a computer readable medium (e.g., a removable storage medium such as one or more DVD-ROM's, CD-ROM's, diskettes, tapes, etc.) that provides at least a portion of the software instructions for the invention system. Computer program product 92 can be installed by any suitable software installation procedure, as is well known in the art. In another embodiment, at least a portion of the Software instructions may also be downloaded over a cable, communication and/or wireless connection. In other embodiments, the invention programs are a computer program propagated signal product embodied on a propagated signal on a propagation medium (e.g., a radio wave, an infrared wave, a laser wave, a sound wave, or an electrical wave propagated over a global network such as the Internet, or other network(s)). Such carrier medium or signals provide at least a portion of the software instructions for the present invention routines/program 92.

In alternate embodiments, the propagated signal is an analog carrier wave or digital signal carried on the propagated medium. For example, the propagated signal may be a digitized signal propagated over a global network (e.g., the Internet), a telecommunications network, or other network. In one embodiment, the propagated signal is a signal that is transmitted over the propagation medium over a period of time, such as the instructions for a software application sent in packets over a network over a period of milliseconds, seconds, minutes, or longer. In another embodiment, the computer readable medium of computer program product 92 is a propagation medium that the computer system 50 may receive and read, such as by receiving the propagation medium and identifying a propagated signal embodied in the propagation medium, as described above for computer program propagated signal product.

Generally speaking, the term "carrier medium" or transient carrier encompasses the foregoing transient signals, propagated signals, propagated medium, storage medium and the like.

Figure 1:
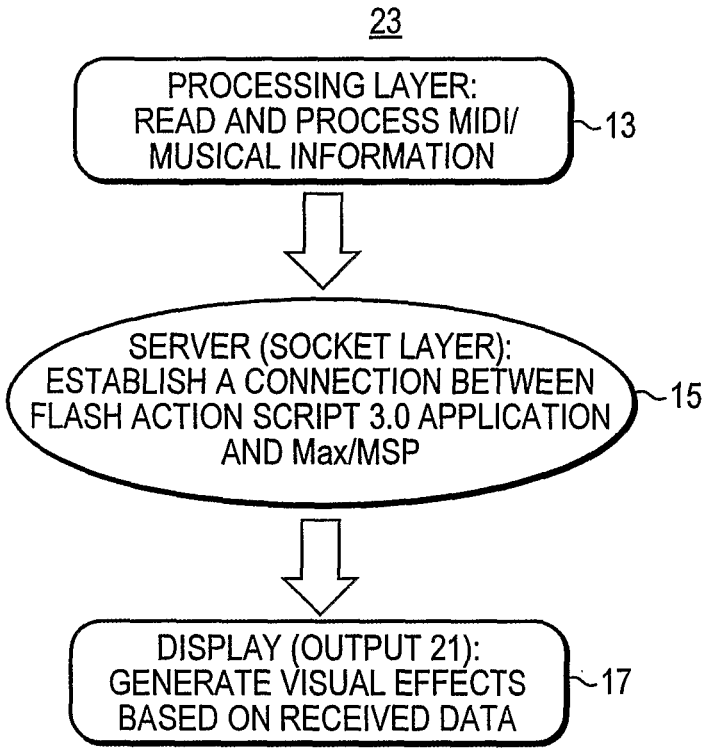
FIG. 1 is a block diagram of system architecture of a music visualizer in a preferred embodiment.

Embodiments 10 may utilize a live audio stream, a recorded/stored audio file, or other audio source (generally indicated 41). The visual display 21 output may include text display of the lyrics and/or other text, graphics and the like. In one embodiment, a rich and informative visual display 21 driven in real-time by live or digital music (or other sound sources/stimuli) 41 is utilized. The display 21 responds to the amplitude and quality of sound and alternatively to several different instruments (or voices) played at the same time. To accomplish this, the music visualizer 23 system architecture of FIG. 1 is presented and can be used to build real-time music visualizations rapidly as discussed next.

Visual Display

Previous to this study, Applicants developed a system that codes sequences of information about a piece of music into a visual sequence that would be both musically informative and aesthetically pleasing. (See S. C. Nanayakkara, et al., "Towards Building an Experiential Music Visualizer," in Proc. of ICICS 2007 (the 6th International Conference on Information, Communications & Signal Processing), IEEE (2007), pgs. 1-5.) Applicants built on this work with input from two deaf musicians (a pianist and a percussionist). Based on their feedback, the final music visualisation system 23 used in Applicants' experiments has visual effects corresponding to note onsets, note duration, pitch of a note, loudness (amplitude), instrument type, timbre, rhythm, beats and key changes.

Music-to-Visual Mapping

Applicants mapped high notes to small shapes and low notes to large shapes, a mapping that is more 'natural' and intuitive than the reverse because it is consistent with experience of the physical world. Similarly, there is a rational basis for amplitude being mapped to visual brightness. This seems to be related to the fact that both amplitude and brightness are measures of intensity in the audio and visual domains respectively, a concept which has been experimentally explored. (See L. E. Marks, "On Associations of Light and Sound: The Mediation of Brightness, Pitch, and Loudness," American Journal of Psychology, 87, 1-2 (1974), pgs. 173-188.) Applicants' informal interviews with deaf musicians suggested that they would like to differentiate between the various instruments that are being played. Applicants therefore used colour information to differentiate between instruments such that each instrument being played at a given time is mapped to a unique colour. Since different keys function musically as a background context for chords and notes without changing the harmonic relationship between them, this analogy was expressed by mapping musical key to the background colour of the display. In addition, many synesthetic artists (those who have reported that they see colours as they hear sounds—see A. Ione and C. Tyler, "Neuroscience, History and the Arts Synesthesia: Is F-Sharp Colored Violet?" Journal of the History of the Neurosciences, 13, 1 (2004), pgs. 58-65), for example Amy Beach and Nikolai Rimsky-Korsakov, have made an association between musical key and background colour.

Another fundamental display decision concerns the window of time to be visualised. Two distinct types of visualisation can be identified: a 'piano roll' and a 'movie roll'-type. The 'piano roll' presentation refers to a display that scrolls from left to right in which events corresponding to a given time window are displayed in a single column, and past events and future events are displayed on the left side and right side of the current time respectively. In contrast, in a 'movie roll'-type presentation, the entire display is used to show instantaneous events which also allows more freedom of expression. The visual effect for a particular audio feature is visible on screen for as long as that audio feature is audible, and fades away into the screen as the audio feature fades away. When listening, people only hear instantaneous events: future events are not known (although they might be anticipated); and past events are not heard (although they might be remembered). Thus, a 'movie roll'-type visual presentation more accurately represents the musical listening process than the 'piano roll' depiction. Applicants' pilot study with deaf musicians confirmed the more natural feel of the 'movie roll'-type presentation.

In one embodiment, one or more of the elements (visual effects) forming the visual display output 21 is user adjustable. Known techniques (e.g., user settable parameters or variables, and the like) are utilized.

Implementation

Extracting note and instrument information from a live audio stream is an extremely difficult problem and is not the main objective of the present invention. Hence, in the first phase of the work, Applicants decided to use Musical Instrument Digital Interface (MIDI) data, a communications protocol representing musical information similar to that contained in a musical score, as the main source of information instead of a live audio stream. Using MIDI makes determining note onsets, pitch, duration, loudness and instrument identification straightforward. However, just as with musical scores, key changes are not explicit or trivially extractable from the MIDI note stream and, to accomplish this task Applicants use manually marked-up scores to determine changes in musical key in some embodiments, and in other embodiments apply a method developed by E. Chew based on a mathematical model for tonality called the 'Spiral Array Model' for automated key identification. The techniques for implementing the Spiral Array Model are known in the art, for example at E. Chew, "Modeling Tonality: Applications to Music Cognition," in Proceedings of the 23rd Annual Meeting of the Cognitive Science Society, Edinburgh, Scotland, UK, Aug. 1-4, 2001, pgs. 206-211.

In a preferred embodiment, the music visualisation scheme (music visualizer 23 architecture) is formed of three main components: Processing layer 13, Server/XML Socket 15, and application output 17 as shown in FIG. 1. The processing layer 13 takes in a MIDI data stream (and/or other audio input) and extracts note onset, pitch, loudness (amplitude), instrument, timbre, rhythm, beats and key changes. The MIDI data stream may be for example from an external MIDI keyboard, read from a standard MIDI file, a generated random MIDI stream, or the like. This processing layer 13 is preferably implemented using the Max/MSP™ musical signal and event processing and programming environment. For example, see O. Matthes, "Flashserver" External for Max/MSP, version 1.1, 2002, freeware at www.nullmedium.de/dev/flashserver. Max midiin and midiparse objects are used to capture and process raw MIDI data coming from a MIDI keyboard. The seq object is used to deal with the standard single track MIDI files. Note and velocity data are read directly from the processed MIDI data. Percussive sounds are separated by considering the MIDI channel number. Key changes are identified using the spiral array model mentioned above.

The extracted musical information in one embodiment is passed to a Flash CS3 program written using Action Script 3.0 via a Max flashserver external object which is the server 15. The basic functionality of the flashserver 15 is to establish a connection between Flash CS3 (display/output layer 17) and Max/MSP (processing layer 13). The TCP/IP socket (at 15) connection that is created enables exchange of data between both programs in either direction thereby enabling two-way Max-controlled animations in Flash CS3™. The visual effects are implemented as a particle animation system. One embodiment employs open-source library version 1.04 of Flint Particle System (at flintparticles.org) developed by Richard Lord for this purpose, and runs the visualizer subsystem 23 on Windows XP or Vista machine with 1 GB RAM compatible processor 84, a 1024×768 monitor resolution with 16 bit video card, and ASIC or compatible sound card. Other configurations are suitable.

Output layer 17 provides through monitor unit 21 display of the generated visual effects corresponding to and coordinated with the source audio 41. Included are displays of text, color-based indications (e.g., of respective features in audio 41), variations (contrast) in visual brightness (e.g., to signify respective amplitudes), and other informative visual effects. In one embodiment, some of the displayed visual effects are user adjustable.

In another embodiment, the output 17/visual display 21 incorporates 3D (three-dimensional) effects. In particular, human gestures (i.e., images or video recordings, and the like, thereof) are synchronized with the music (audio source) 41 and used to convey an improved musical/sound experience.

Implementation of 3D Abstract Patterns

It can be argued that a 3D visual display might provide more options to display visual effects corresponding to features of the music 41 being played. In general, 3D visuals have the potential to increase the richness of mappings as well as the aesthetics of the display over a 2D design. The Flint Particle Library version 2.0 (of flingparticles.org) is used to implement the 3D effects into the visual display 21 in one embodiment.

One particular improvement made using the 3D capabilities was making the particles corresponding to non-percussive instruments appear in the centre of the screen at 21 with an initial velocity towards the user then accelerating away from the user (into the screen at 21). As a result, it appears to the user that the particle first comes closer for a short instant, and then recedes, slowly fading away as the corresponding note "dies out" in the music piece 41. This movement greatly improves the appearance of the animator as it adds a real-life factor to the display 21. The colouring and presentation of particles may be kept consistent with that of the 2D implementation described above. As for the percussive instrument based particles, the positions are still kept at the bottom of the screen in the 3D view. However, the behaviour was changed so that when such a particle appears on screen 21, it shoots upwards before disappearing. This behaviour was introduced because the upward movement is attention-grabbing, and thus enhances the visual effect of the percussive instruments in the music flow.

Music Visualisation with Human Gestures

It has often been noted that hearing-impaired people employ lip-reading as part of the effort to understand what is being said to them. One possible explanation for this comes from the hypothesis of "motor theory of speech perception" which suggests people perceive speech by identifying the vocal gestures rather than identifying the sound patterns. This effect could be even more significant for people with hearing difficulties. The McGurk effect (H. McGurk and J. MacDonald, "Hearing lips and seeing voices," *Nature*, vol. 264, pp. 746-748, 1976; and L. D. Rosenblum, "Perceiving articulatory events: Lessons for an ecological psychoacoustics," in *Ecological Psychoacoustics*, J. G. Neuhoff, Ed. San Diego, Calif.; Elsevier, 2004, pp. 219-248) suggests that watching human lip-movements might substantially influence the auditory perception. McGurk and MacDonald (1976) found that seeing lip-movements corresponding to "ga" results in the audible sound "ba" being perceived as "da". Moreover, J. Davidson (1993), Boone and Cunningham (2001) have shown that body movements contain important information about the accompanying music (see J. Davidson, "Visual perception of performance manner in the movements of solo musicians," *Psychology of Music*, vol. 21, pp. 103-113, 1993; and R. T. Boone and J. G. Cunningham, "Children's expression of emotional meaning in music through expressive body movement," *Journal of Nonverbal Behavior*, vol. 25, pp. 21-41, 2001). This could be one of the possible explanations as to why many people tend to enjoy live performances of music, even though a quiet room at home seems to be a more intimate and pristine listening environment. Combining these factors, the effects and experiences of hearing-impaired people were explored when they are exposed to simple series of "ba" "ba" lip-movements corresponding to the beat of the music.

Lip/Face Animation

The results from a preliminary user study with hearing-impaired participants show that a facial movement involved in saying the syllable "ba" with the beat of the song might be helpful. This was assumed to be particularly true for songs with a strong beat. The closing and opening of lips while making a "ba" movement, was something deaf people were likely to understand easily as verified by the preliminary user study. As a result, the video display at 21 was replaced with a video recording of a young woman making the "ba" "ba" lip movements.

In one embodiment of invention system 10, a video recording of a human character making lip/facial movements corresponding to the music being played is employed. Apart from making the lip movements, the human character makes other facial changes to complement the lip movement. As the lips come together, the eyelids close a bit and the eyebrows come down. Also, the head tilts slightly to the front like it would when a person listening to music is beginning to get into the rhythm of it. As soon as the lips are released to move apart, the eyes open more, eye brows move upwards and the head gives a slight jerk to move backwards, keeping the lip movement in sync with the rest of the face.

Conductor's Expressive Gestures

The facial/lip movement strategy described above is more suitable to express music with a strong beat. However, a simple facial animation seemed insufficient to express the richness of a classical music piece.

During a typical orchestral performance, an experienced conductor would transmit his/her musical intentions with highly expressive visual information through gestures. In fact, it has been reported that a conductor's left arm indicates features such as dynamics or playing style while the right arm indicates the beat. Therefore, to convey a better listening experience while listening to classical music, Applicants decided to show a conductor's expressive gestures on a visual display 21 for the listener-user to see while sitting on the Haptic Chair 31.

Wöllner and Auhagen (C. Wöllner and W. Auhagen, "Perceiving conductors' expressive gestures from different visual perspectives. An exploratory continuous response study," *Music Perception*, vol. 26, pp. 143-157, 2008) have shown that watching the conductor from positions of woodwind players and first violists is perceptually more informative compared to that from the cello/double bass position. Therefore, Applicants positioned a video camera next to the woodwind players, and recorded the conductor's expressive gestures (e.g., during a music director conducting the Mendelssohn's Symphony No. 4.)

The proposed approach of showing lip/facial movements and conductor's expressive gestures synchronised to music were compared with the previously found best case (showing abstract animations synchronised with the music). The results are summarised in Exemplification III.

The 'Haptic Chair'

Applicants propose that if vibrations caused by sound could be amplified and sensed through the body as they are in natural environmental conditions (feeling vibrations through sense of touch and sound through bone conduction), this might increase the enjoyment of music over a mute visual presentation or simply increasing the volume of sound. Thus Applicants developed (among other components) a device designed to achieve this which is referred to as the 'Haptic Chair' 31. Initial tests suggest that the prototype enables the listener to be comfortably seated while being enveloped in an enriched sensation created by the received sound.

Implementation

The current concept underlying the Haptic Chair 31 is to amplify vibrations produced by musical sounds without adding any additional artificial effects into this communications channel, although such an approach may be useable in some embodiments. In one embodiment, the Haptic Chair 31 is formed/constructed by the mounting of several vibration sources onto a chair and providing a means of mapping audio signals into vibrations to be felt by the sense of touch and through bone conduction of sound by the user (person seated in the chair). The chair 31 has a solid frame with flat surfaces that allows proper contact of the vibrating sources with the chair material. A solid chair constructed from materials such as wood, metal, plastic or glass provide a good medium for transmitting the vibrations. Cushioned chairs constructed from soft materials in general, are not as suitable since much of the vibrations will be damped by the soft materials especially those not of uniform composition.

The vibrating sources are provided by special speakers that convert audio signals into powerful vibrations that are transferred onto solid surfaces by direct contact. These special speakers are commercially available from several manufacturers where they are marketed as a means of providing an acoustic source for audio applications rather than a means of vibration for other applications. The quality and frequency response of the sound that these speakers produce is similar to that of conventional diaphragm speakers. This is important since many partially deaf people can hear some sounds via in-air conduction through the 'conventional' hearing route: an air-filled external ear canal. Some non-limiting examples of these speakers include the Nimzy Vibro Max and the SolidDrive® SD1. The SolidDrive® SD1 in particular, provides high output power making it most suitable for the construction of the Haptic Chair 31. The SolidDrive® SD1 range of speakers has an impedance of 6 or 8 ohms and has a frequency response ranging from 70 Hz to 15 kHz. They can work with an amplifier power of up to 100 watts.

In a preferred embodiment, the Haptic Chair 31 design starts with a densely laminated wooden chair with a frame comprised of layer-glued, bent beech wood which provides flexibility and solid beech cross-struts that provide rigidity. The POÄNG arm chair by IKEA is exemplary. Such a chair is able to vibrate relatively freely and can also be rocked by the subjects. FIG. 2*a* is illustrative. Two contact speakers 33 are mounted under the arm-rests 20, one under a similar rigid, laminated wood foot-rest 22, and one on the back-rest 24 at the level of the lumbar spine (the effects on which also impacts the thorax). In a non-limiting example, two Nimzy™ Vibro Max speakers 33*a,b* are placed on the underside of the left and right arm rests 20, where each speaker's vibrating surface makes direct contact with the wooden frame of the chair.

A thin but rigid plastic dome 25 is placed on the top side of each arm rest 20 directly above speakers 33*a,b* and help to amplify vibrations produced by high frequency sounds and sensed by hands and fingers by the sense of touch and through bone conduction of sound. The domes 25 also provide an ergonomic hand rest that bring fingertips, hand bones and wrist bones in contact with the vibrating structures in the main body of the chair 31. The arm rests 20 also serve to conduct sound vibrations to the core of the user's body and the sound signal is presented in conventional stereo output to the right and left arm rests 20.

Figure 4A:
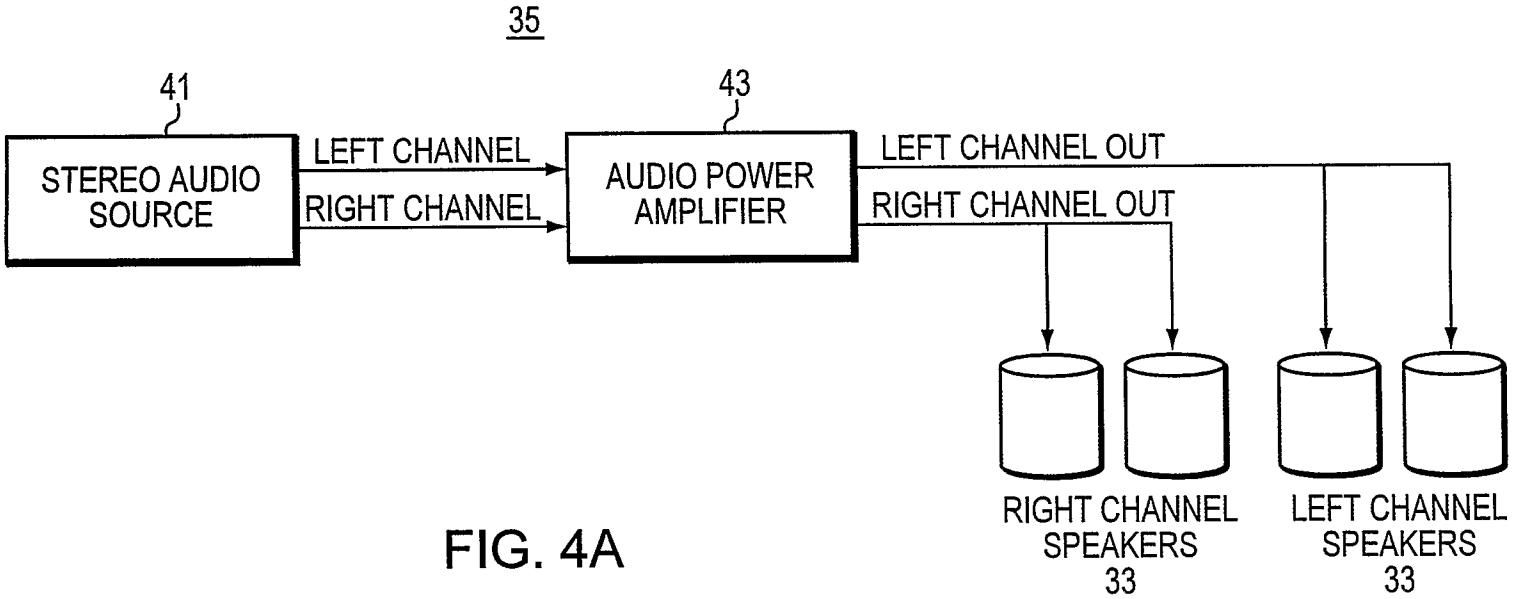
FIGS. 4*a*-4*b* are block diagrams of respective sound systems (speaker systems) employed by the haptic chair embodiments in FIGS. 2*a*-2*c*.

FIG. 4*a* illustrates this speaker subsystem 35 configuration. From a stereo audio source 41, left and right channels are amplified by power amplifier 43. The amplified left and right channels are then fed into respective left and right speakers 33 (e.g., 33*a,b*). In one embodiment, power amplifier and audio control unit 43 (FIG. 2*a*) includes user-adjustable controls that control the intensity of the vibrations of the speakers 33.

For the speaker 33*d* mounted to the back rest 24, the speaker 33*d* is preferably mounted on a metal bracket and attached to the back of the chair 31. The vibrating surface of the speaker 33*d* does not make any physical contact with the chair 31, but is instead mounted such that it makes contact with the lower/middle back (along the spinal cord) of the user when the user sits and leans back. For added comfort to the user, a thin layer of cotton cushioning can be placed covering the back of the chair. From user feedback, this arrangement does not significantly reduce the effectiveness of the vibration from the back of the chair.

At the footrest 22, a speaker 33*c* (e.g., a SolidDrive® SD1) is preferably mounted underneath the wooden footrest 22 where the speaker's vibrating surface makes direct contact with the wooden base causing it to vibrate along with the audio source 41. This configuration allows users to feel vibrations (through the sense of touch and by bone conduction of sound) from the base of their feet.

In one embodiment, a textured cotton cushion with a thin foam filling was designed to fit the frame of the chair to increase physical comfort but not significantly interfere with haptic perception of the music. Various configurations are suitable.

The first emphasis here is to provide users with sensations in the form of vibrations that are synchronized with an audio source 41 while in a comfortable position. This concept will work as long as there is direct contact between the vibrating speaker 33 and the human body of the user or if there is a conducting medium between the vibrating speaker 33 and the human body. Examples of conducting mediums can include any material with a flat surface such as wood, glass, metal, plastic and others. The intensity of the vibration tends to vary with the density of the material. Hard surfaces conduct the vibrations better while softer materials give less vibration. Placement of the vibrating speakers 33 which defines the contact positions with different parts of the human body of the user, is not limited to the locations used in the above-described embodiments. Different configurations with different contact points are possible and will provide different sensations to the human body. The concept of the present invention also works on a bench, bed, table or any other furniture that makes contact with the human body of a user. The present invention is also not limited to furniture. A vibrating floor (i.e., wooden platform), a portable vibrating device (e.g., a vibrating sound board), a wearable, vibrating piece of clothing, shoes, are just some other examples since they are objects that make close contact to the human body.

The second emphasis is placed on the audio source itself. In the illustrated embodiments of FIGS. 2*a*-2*c*, a stereo audio source 41 may be used, but the concept can be generalized to a multi-channel audio source connected to multiple vibrating speakers 33, 29. Multi-channel audio is extensively used in movie theaters, home theater systems, gaming environments and others. Accordingly, embodiments of the present invention may be installed in theaters, concert halls, etc. so that hearing impaired people can experience live or prerecorded musical performances to a level of qualitatively similar to people with normal hearing. Also, an embodiment can be made portable so that a hearing impaired person is able to carry it to a live performance. In another example embodiment, the present invention system may be incorporated into cars or tour buses. Further, at the very least, an embodiment of the present invention can be used as an aid in learning to play a musical instrument or to sing in tune, or as an entertainment system for people with normal hearing to experience an enhanced sense of music.

The strength of vibrations were measured in different parts of the chair 31 in one embodiment in response to different input frequencies using an accelerometer (3041A4, Dytran Instruments, Inc.). The output of the accelerometer was connected to a signal conditioner. The output of the signal conditioner was collected by a data acquisition module (USB-6251, National Instruments) and processed by a laptop running LabVIEW™ 8.2. The system frequency response was tested in the range of 50-5000 Hz, where the lower frequency was limited by the response of the contact speakers 33 and upper limit was chosen such that it effectively covers the range of most musical instruments. The response measured from the foot rest 22 and the back rest 24 of the chair 31 was fairly flat (±5 dB) while the response measured from the arm rests 20 showed more fluctuations (±10 dB) with lower amplitude.

It was observed that the strength of the vibrations felt through the hand-rest domes 25 was considerably weaker compared to those at other locations of the chair 31 (especially back-rest 24 and foot-rest 22). Therefore, in another embodiment the rigid plastic domes 25 are replaced by a set of flat panel speakers (e.g., NXT™ Flat Panels Xa-10 from TDK) 29*a, b* (FIGS. 2*b*-2*c*) to improve the vibrations felt by the finger tips, a particularly important channel for sensing higher frequencies.

Flat panel speakers 29*a, b* were found to be a cheaper alternative to produce stronger vibrations at the hand-rest area compared to vibrations produced by the plastic dome structure 25 on the distal end of the arm-rest 20. With this modification, the location of the contact speakers 33*a, b* was shifted further back (proximal) along the arm-rest 20 towards where the elbow of the listener-user naturally contacted the chair 31. The purpose of this was to maintain the vibrations felt via the wooden arm-rest 20. These modifications are shown in FIGS. 2*b* and 2*c*.

Figure 4B:
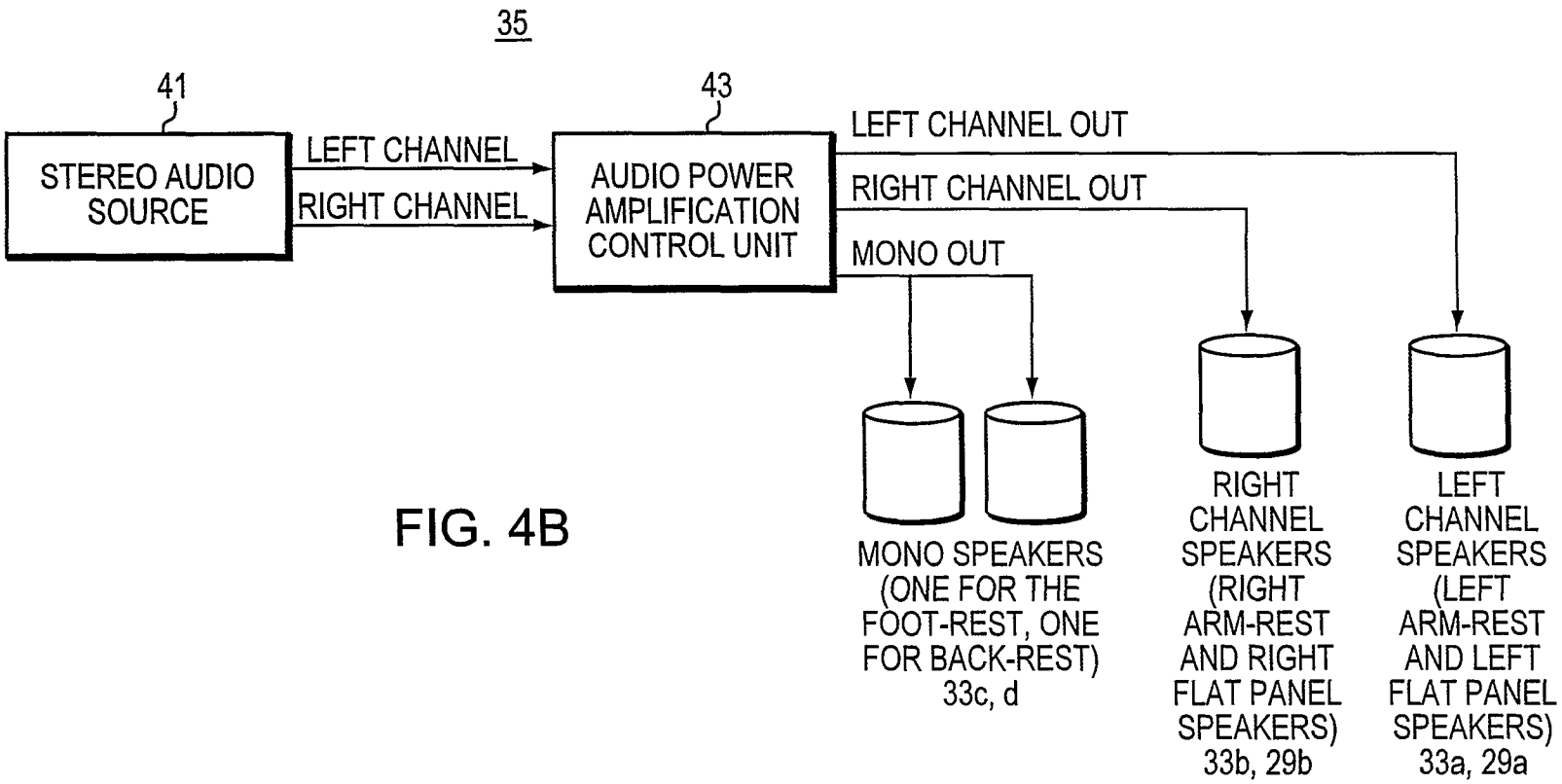

FIG. 4*b* illustrates the speaker subsystem 35 for the six speaker configuration of haptic chair 31 of FIGS. 2*b*-2*c*. From a stereo audio source 41, audio power amplifier 43 amplifies audio data and feeds a left channel output, a right channel output and a monaural output line. These amplified channels then drive or supply amplified sound (audio input) to respective left and right speakers 33*a, b*, 29*a, b* (at arm rests 20) and to mono speakers 33*c, d* (at the foot rest 22 and chair back/backrest 24). In one embodiment, audio power amplifier and control unit 43 may include user adjustable controls to control the intensity of the vibrations of the speakers 29, 33.

After the modification, the frequency response of the chair 31 at the distal end of arm rest 20 (general position of flat panel speakers 29 in FIGS. 2*b*-2*c* embodiment) was compared with that of the FIG. 2*a* embodiment. Since the flat panel speakers 29*a, b* were attached at the distal end of arm rest 20, the response from the other positions of the chair 31 was not affected by the addition of flat panel speakers 29. This is because the flat panel speakers 29*a, b* do not operate in the same way as the contacts speakers 33*a, b*. Since the flat panel speakers 29 operate similarly to conventional diaphragm speakers, they do not directly vibrate the structure they are in contact with. Hence, the flat panel speakers 29*a, b* did not introduce significant additional vibration to the chair 31 structure.

The frequency responses of the distal end of arm rest 20 in the embodiment of FIGS. 2*b* and 2*c* is much higher than the frequency response of the distal end of arm rest 20 in the FIG. 2*a* embodiment. In other words, the introduction of the flat panel speakers 29*a, b* provides better haptic input to the fingertips of the listener-user (i.e., person seated in the chair 31).

EXEMPLIFICATION I

A user evaluation study was carried out to examine the effectiveness of the invention system 10. Participants were asked to follow the music while sitting in the Haptic Chair 31 and watching the visual display 21. They were also invited to make themselves comfortable in the chair "as if they were relaxing at home". The studies were conducted in accordance with the ethical research guidelines provided by the Internal Review Board (IRB) of the National University of Singapore and with IRB approval.

Participants

Forty three hearing-impaired participants (28 male subjects and 15 female subjects) took part in the study. Their median age was 16 years ranging from 12 to 20 years. All participants had normal vision. The participants in this study were not the same group of subjects who took part in the background survey and informal design interviews and therefore provided Applicants with a fresh perspective. Applicants communicated with the participants through an expert sign language interpreter.

Apparatus

The study was carried out in a quiet room resembling a home environment. A notebook computer with a 17-inch LCD display was used to present the visual effects. Applicants did not include the size of the LCD display as a variable in this study, and chose the commonly available 17 inch monitor that was both easily portable and widely available in homes and workplaces. During, the various study blocks, subjects were asked to sit on the Haptic Chair 31 (keeping their feet flat on the foot rest and arms on the armrests), and/or to watch the visual effects while listening to the music, or simply listen to the music. The visual display 21 was placed at a constant horizontal distance (approximately 150 cm) and constant elevation (approximately 80 cm) from the floor. Participants switched off their hearing aids during the study.

Procedure

The experiment was a within-subject 4×3 factorial design. The two independent variables were: musical composition (classical, rock, or beat only) and prototype configuration (neither visual display nor Haptic Chair, visual display only, Haptic Chair only, and visual display and Haptic Chair). The musical test samples were based on the background survey results. MIDI renditions of Mozart's Symphony No. 41, 'It's my life' (a song by the band called Bon Jovi), and a hip-hop beat pattern were used as classical, rock, and beat only examples, respectively. Samples of these tracks are available online at artsandcreativitylab.org/publication/chi09-music-tracks. The duration of each of the three musical test pieces was approximately one minute.

For each musical test piece, there were four blocks of trials (see Table 1). In all four blocks, in addition to the prototype system, the music was played through a normal diaphragm speaker system (Creative™ 5.1 Sound Blast System) which is best common practice. Before starting the blocks, each participant was told that the purpose of the experiment was to study the effect of the Haptic Chair and the visual display. In addition, they were given the chance to become comfortable with the Haptic Chair and the display. Also, the sound levels of the speakers were calibrated to the participant's comfortable level. Once the participant was ready, trials were presented in random order.

TABLE 1

Four trials for a piece of music.

| Trial | Visual Display | Haptic Chair | Task |
|---|---|---|---|
| A | OFF | OFF | Follow the music |
| B | ON | OFF | Follow the music while paying attention to the visual display |
| C | OFF | ON | Follow the music while paying attention to the vibrations provided via the Haptic Chair |
| D | ON | ON | Follow the music while paying attention to the visual display and vibrations provided via the Haptic Chair |

After each block, the subjects were asked to rate their experience by answering a questionnaire. The questions were designed based on the Flow State Scale (FSS) of S. A. Jackson and H. W. Marsh, "Development and Validation of a Scale to Measure Optimal Experience: The Flow State Scale," in Journal of Sport and Exercise Psychology, 18 (1996), pgs. 17-35. Each question was rated on a 5-point scale, ranging from 1 (strongly disagree) to 5 (strongly agree). Upon completion of the four trials for a given piece of music, the participants were asked to rank these four configurations (A, B, C and D as shown in Table 1) according to their preference. This procedure was repeated for the 3 different musical pieces. Each subject took approximately 45 minutes to complete the experiment. It took 8 days to collect responses from 43 participants.

Results and Analysis

Applicants analysed the collected responses to find the answers to initial question's of this disclosure. The overall FSS score was used as a measure of the optimal experience. The FSS score was calculated as a weighted average of the ratings given for the questions, and ranged from 0 to 1 where a FSS score of 1 corresponded to an optimal experience.

Figure 5:
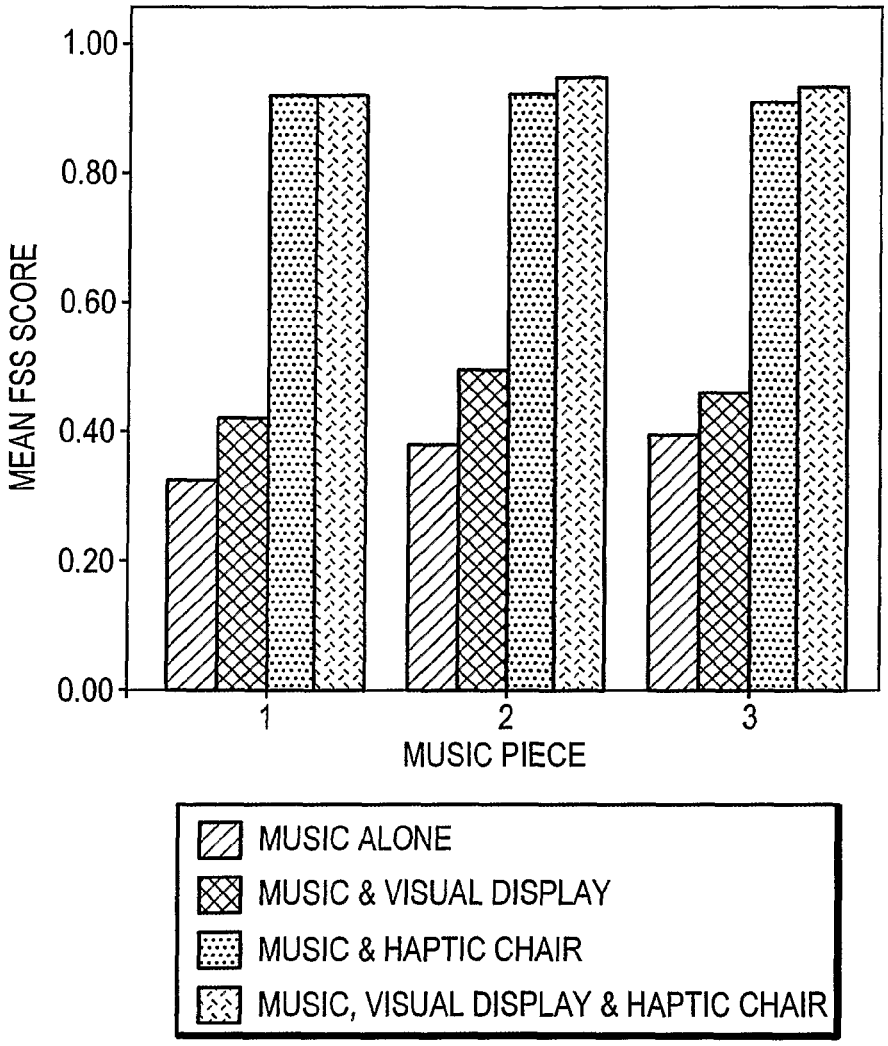
FIG. 5 is a graph of overall FSS (Flow State Scale) scores in Exemplification I of the present invention.

Preliminary investigations were carried out to examine the effect of the proposed system 10. For this purpose, Applicants graphed the mean FSS score across all experimental conditions (presented as FIG. 5). From the results shown in FIG. 5, it is clear that the Haptic Chair 31 had a dominant effect on the FSS score. Also, the FSS score was minimal for the control situation in which both the visual display 21 and Haptic Chair 31 were turned off. A 2-way repeated measures ANOVA ($F_{obs}$ 2.851, $p>0.05$) suggested that the order of blocks (different pieces of music) did not significantly affect the FSS score.

The average mean FSS score was compared across the four different experimental combinations: music only; music and visual display 21; music and Haptic Chair 31; music, visual display 21 and Haptic Chair 31. A one way repeated measures ANOVA reveals a significant difference between the different combinations ($F_{obs}$ 584.208, $p<0.01$).

Applicants used Tukey's honestly significant difference (HSD) test to compare the means. The outcome of this test was as follows:

Mean FSS score of music with visuals (Trial B) was significantly higher ($p<0.01$) than music alone (Trial A).

Mean FSS score of music with Haptic Chair (Trial C) was significantly higher ($p<0.01$) than music alone (Trial A).

Mean FSS score of music, visuals and Haptic Chair together (Trial D) was significantly higher ($p<0.0$) than music alone (Trial A).

Mean FSS scores of music, visuals and Haptic Chair together (Trial D) and music with Haptic Chair (Trial C) were significantly higher ($p<0.1$) than music and visuals (Trial B).

The difference between the mean FSS score of music with Haptic Chair (Trial C) and music, visuals and Haptic Chair (Trial D) was not significant ($p>0.05$).

Figure 6:
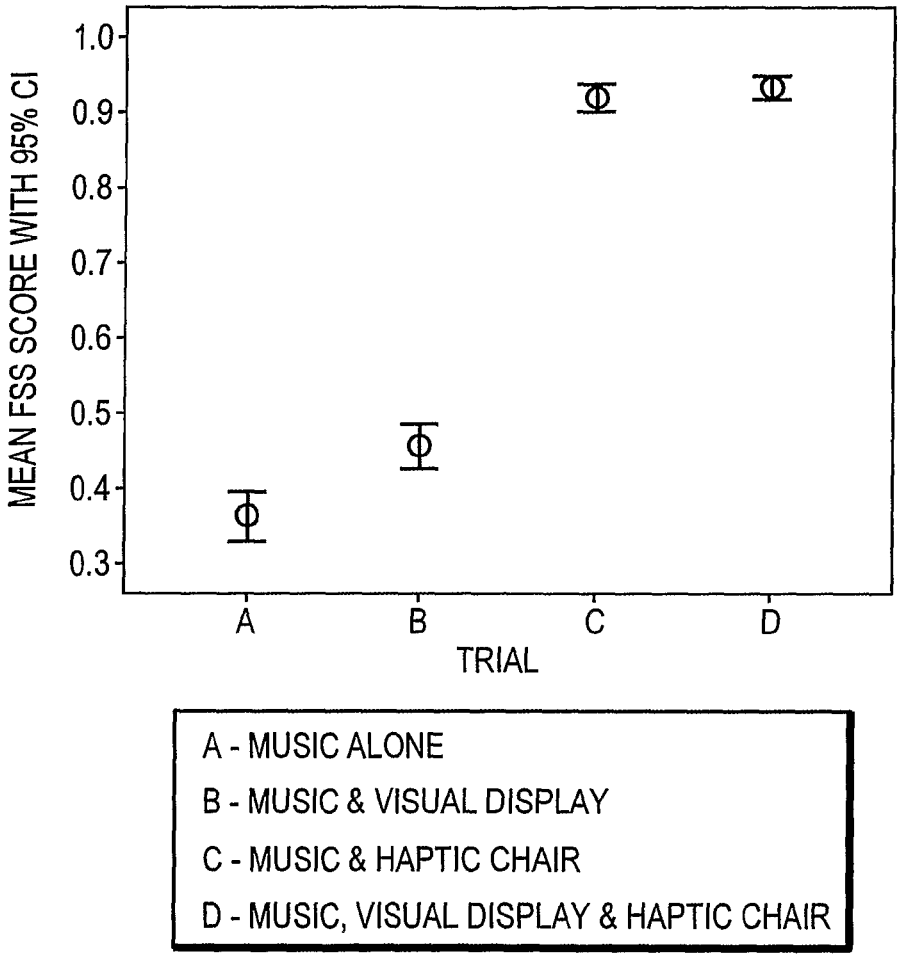
FIG. 6 is a plot of FSS scores for four different combinations of the Exemplification I.

FIG. 6 presents a plot of FSS score with 95% Confidence Interval (CI) for four different combinations, namely A—music alone, B—music and visual display, C—music and Haptic Chair, and D—music, visual display and Haptic Chair. As seen from FIG. 6, the Haptic Chair 31 had a substantial effect on the FSS score. When the participants were asked to rank the most preferred configuration, 54% chose music together with the Haptic Chair, 46% ranked music and visuals together with the Haptic Chair as their first choice. None of the participants preferred the other possible options (music alone, or music with visual display).

The low FSS scores for the music alone and music plus visuals options can be explained by some of the comments received from the participants. One said:

> "I can't hear with the visuals alone, but when I get the vibrations [from the Haptic Chair], there is a meaning to the visuals."

EXEMPLIFICATION II

The statistical analysis given above shows that the Haptic Chair 31 has the potential to significantly enhance the musical experience of a hearing impaired person. However, this does not adequately reflect the enthusiasm Applicants received from the deaf community. After the formal study was completed, Applicants had the opportunity to interact with the deaf participants in a more informal way that provided insight into how the invention system 10 worked in a more natural environment.

Applicants selected a sub-group of eleven particularly enthusiastic subjects and allowed them to listen to songs of their choice. They were asked to imagine the Haptic Chair was their own and use it in whatever way they wanted. They were also given a demonstration of how to connect an audio device (mobile phone, CD player, Apple iPod, or notebook computer) to the Haptic Chair 31, and they were free to choose whether or not to use their hearing aids. Applicants observed the behaviour of the participants and, after the session, asked them for their reactions to the experience.

One very excited participant reported that it was an amazing experience unlike anything she had experienced before. She said now she feels like there is no difference between herself and a person with normal hearing. She preferred the combination of the Haptic Chair and visual display the most. She said, if she could see the lyrics (karaoke-style) and if she had the opportunity to change the properties of the visual display (colour, objects, how they move, etc.) whenever she feels, that would make the system even more effective.

Many of the participants reported that they could clearly identify the rhythm of the song and could hear the song much better compared to when using standard hearing aids. Another mentioned that he wanted to use headphones together with the chair 31 and display 21 so that he could detect the sound through the headphones as well.

A few participants who were born with profound deafness said that this was the first time they actually 'heard' a song and they were extremely happy about it. They expressed a wish to buy a similar Haptic Chair and connect it to the radio and television at home.

Applicants observed that many profoundly deaf participants were actually 'hearing' something when they were sitting on the chair 31. The following comments were encouraging:

"Yes, I can hear from my legs!"

"I will ask my father to buy me a similar chair."

"Now there is no difference between me and a normal hearing person. I feel proud."

Applicants consulted deaf musicians to get their feedback on future developments for the invention system 10. One of them (a deaf teacher of music) said that she enjoyed the experience provided by the Haptic Chair 31 and suggested that Applicants should provide an additional pair of conventional headphones together with the Haptic Chair 31 to assist partially deaf people who can detect certain sounds via air conduction through their external ear canal.

A profoundly deaf concert pianist told Applicants that he could detect almost all important musical features via the Haptic Chair 31 but wanted to feel musical pitch more precisely. When Applicants explained the options and the need for familiarisation with the system for such a high level input of information, he said he learned continuously throughout his initial test of the system and would continue to participate in refining the concept.

EXEMPLIFICATION III

Three different user studies were carried out to evaluate a different (revised) embodiment having the visual display 21 with 3D effects and the Haptic Chair 31 of FIGS. 2*b* and 2*c*. The following includes a summary of the experimental procedures, results and discussion.

Comparison of the Proposed Music Visualisation Strategies

The objective of this study was to compare the performance of the two new visualisation strategies. The proposed techniques (3D abstract patterns, the human gestures) were compared with the previously best known combination (Haptic Chair plus 2D visual display of Exemplification I).

Participants, Apparatus and Procedure

Thirty six hearing-impaired participants (21 male and 15 female) took part in the study. All had normal vision. An expert sign language interpreter's service was used to communicate with the participants.

The study was carried out in a quiet room resembling a home environment. As in previous studies, a notebook computer with a 17-inch LCD display was used to present the visual effects and was placed at a constant horizontal distance (approximately 170 cm) and constant elevation (approximately 80 cm) from the floor. During the various study blocks, participants were asked to sit on the Haptic Chair 31 (keeping their feet flat on the foot rest 22, arms on the armrests 20 and finger tips on the flat panel speakers 29), and to watch the visual effects while listening to the music. Participants were asked to switch off their hearing aids during the study.

The experiment was a within-subject 3×2 factorial design. The two independent variables were: musical genres (classical and rock) and type of visuals (2D abstract patterns; 3D abstract patterns; and video recorded or otherwise image captured human gestures synchronised with the music). MIDI renditions of Mendelssohn's Symphony No. 4 and "It's my life" (by Bon Jovi) were used as classical and rock examples, respectively. The duration of each of the two musical test pieces was approximately one minute. For each musical test piece, there were three blocks of trials as shown in Table 2. In all three blocks, in addition to the visual effects, music was played through the Haptic Chair 31 to provide a tactile input. Before starting the blocks, the participants were given the opportunity to become comfortable with the Haptic Chair 31 and the display 21. The sound levels of the speakers 33, 29 were calibrated to the participant's comfortable level. Once each participant was ready, stimuli were presented. The order of the trials was distributed equally among all possible combinations.

TABLE 2

Three different trials for a piece of music used to compare different music visualisation strategies

| Trial | Visual Display | Haptic Chair | Remark |
|---|---|---|---|
| A | 2D | ON | Best known condition (Exemplification I) |
| B | 3D | ON | Implementation of the visual effects "ba" "ba" lip/facial movement for the rock song; |
| C | Human gestures | ON | Orchestral conductor's expressive gestures for the classical piece |

The FSS instrument described above was used to measure the experience of the participants. This procedure was repeated for the 2 different musical pieces. Each participant took approximately 25 minutes to complete the experiment. The experiment took place over 7 days to collect responses from 36 participants.

Results

Figure 7:
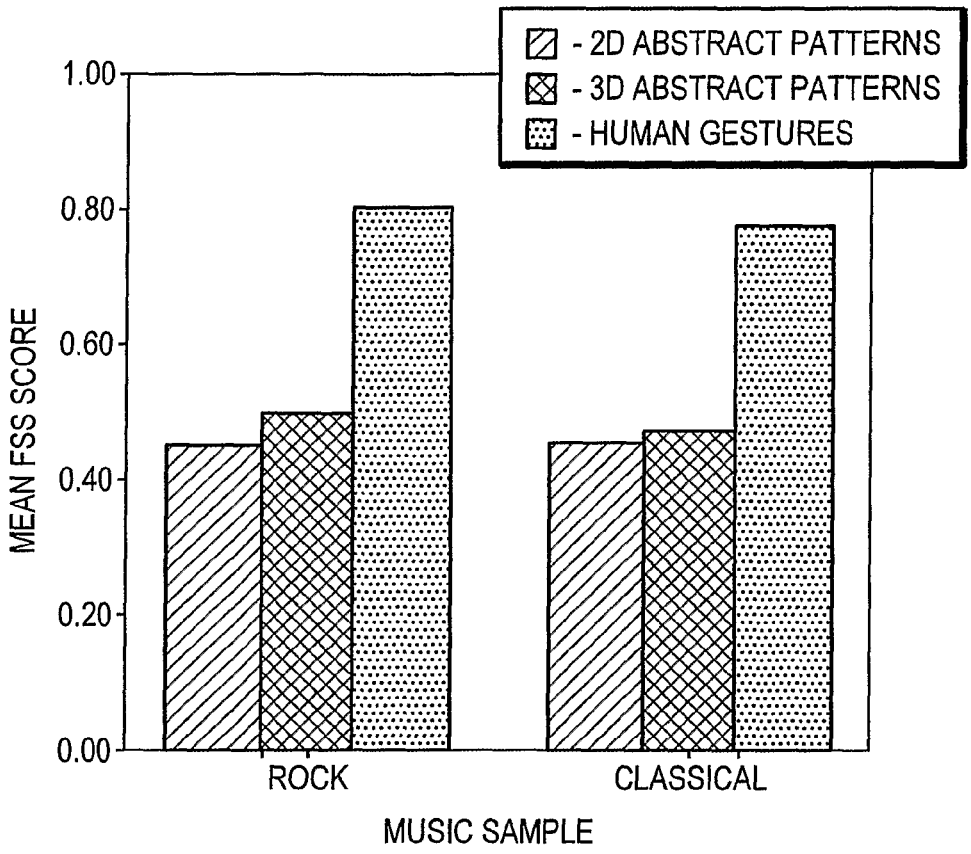
FIG. 7 is a graph of overall FSS scores comparing 2D visual display to 3D visual display and human gestures in Exemplification III.

FIG. 7 shows the mean FSS score across the experimental conditions. From the figure, it is appears that watching human gestures with music has a dominant effect on the FSS score.

The difference between the responses observed for the two different music samples (classical and rock) was not significant. This was verified by a 2-way repeated measures ANOVA ($F_{obs}<1$) and suggested that the music genre did not significantly affect the FSS score. Therefore, results obtained from different music genres were combined.

Figure 8:
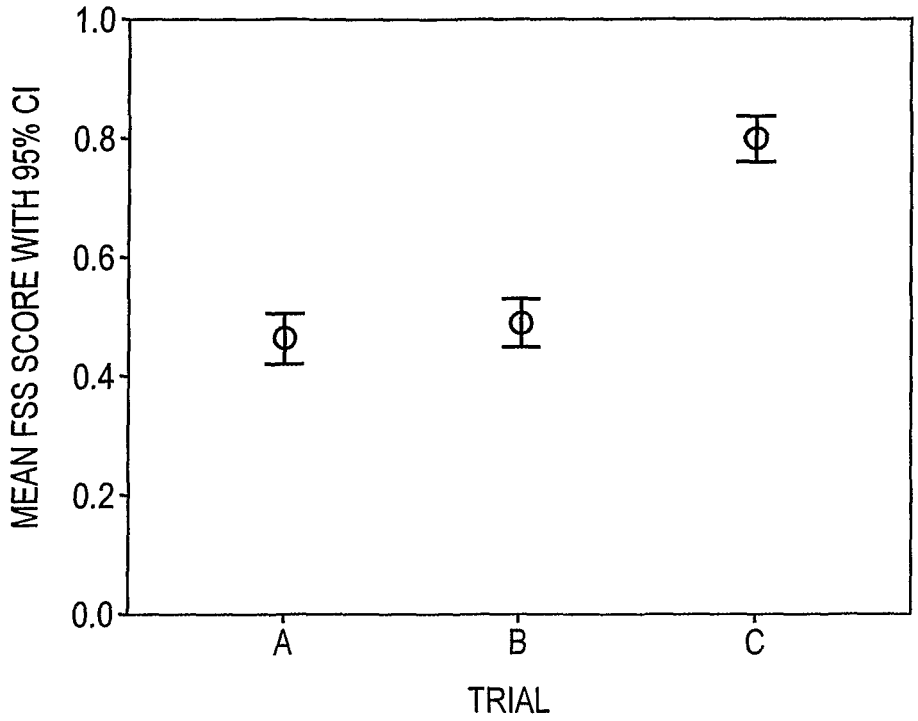
FIG. 8 is a plot of the mean FSS score for three different combinations of the test conditions shown in FIG. 7 of Exemplification III.

One way repeated measures ANOVA analysis was carried out to compare the average mean FSS score across the three different experimental combinations. This revealed a significant difference between the different combinations ($F_{obs}91.19$, $p<0.01$). As seen from FIG. 8, listening to music while watching synchronised human gestures and feeling the vibration through Haptic Chair 31 (Trial C) was found to be the most effective way to convey a musical experience to a hearing-impaired person. Tukey's HSD test was used to compare the means. The outcome of this test was as follows:

Mean FSS score of watching human gestures (Trial C) was significantly higher ($p<0.01$) than watching 2D abstract patterns (Trial A—best case from FIG. 6) or watching 3D abstract patterns (Trial B).

The difference between the Mean FSS scores of watching 2D abstract patterns (Trial A) and watching 3D abstract patterns (Trial B) is not statically significant ($p>0.05$).

Many participants reported that they could "hear" better when watching human gestures while listening to music sitting on the Haptic Chair 31. Referring to face/lip movements and conductor's gestures, some participants said these (gestures) are more musical. Only one participant commented that the conductor's gestures were difficult to understand. Perhaps this was because conductor's gestures were particularly subtle. Overall, most of the participants liked to watch human gestures synchronised to music. From the statistical analysis, comments received from the participants and their level of excitement observed, it appeared that the use of human gestures was the right approach for enhancing the musical experience through visuals.

Synchronised Gestures vs Asynchronised Gestures

The objective of conducting this experiment was to find out the importance of presenting music-driven human gestures as opposed to random human gestures. To answer this issue, a comparison of three different scenarios—human gestures synchronised with music, human gestures asynchronised with music and music without any visuals—was carried out.

Participants and Apparatus and Procedure

Twelve hearing-impaired participants (7 male and 5 female students) took part in this study. All of them had taken part in the previous study. As previously, an expert sign language interpreter's service was used to communicate with the participants. Same set up—a 17-inch LCD display placed at a constant horizontal distance (approximately 170 cm) and constant elevation (approximately 80 cm) from the floor in a quiet room resembling a home environment—was used to present the visual effects.

The experiment was a within-subject 3×2 factorial design. The two independent variables were: musical genres (classical and rock); type of visuals (no visuals; music with synchronised human gestures; and music with asynchronised human gestures). The same music samples used in the previous experiment (Mendelssohn's Symphony No. 4 and "It's my life" by Bon Jovi) were used.

TABLE 3

Three different trials for a piece of music were conducted to compare the effectiveness of synchronised and asynchronised human gestures

| Trial | Visual Display | Haptic Chair | Remark |
|---|---|---|---|
| A | No visuals | ON | Control case |
| B | Music with synchronised human gestures | ON | Gestures correspond to the music being played |
| C | Music with asynchronised human gestures | ON | Gestures do not correspond to the music being played |

For each musical test piece, the participants were shown 3 sets of stimuli—music alone, music with synchronised gestures, and music with asynchronised gestures as shown in Table 3. In all conditions, participants were given tactile input through the Haptic Chair 31. After each trial, each participant's experience was measured using the FSS instrument. This procedure was repeated for the 2 different musical pieces. Each participant took approximately 25 minutes to complete the experiment. Data was collected from the 12 participants over a period of 3 days.

Results

Figure 9:
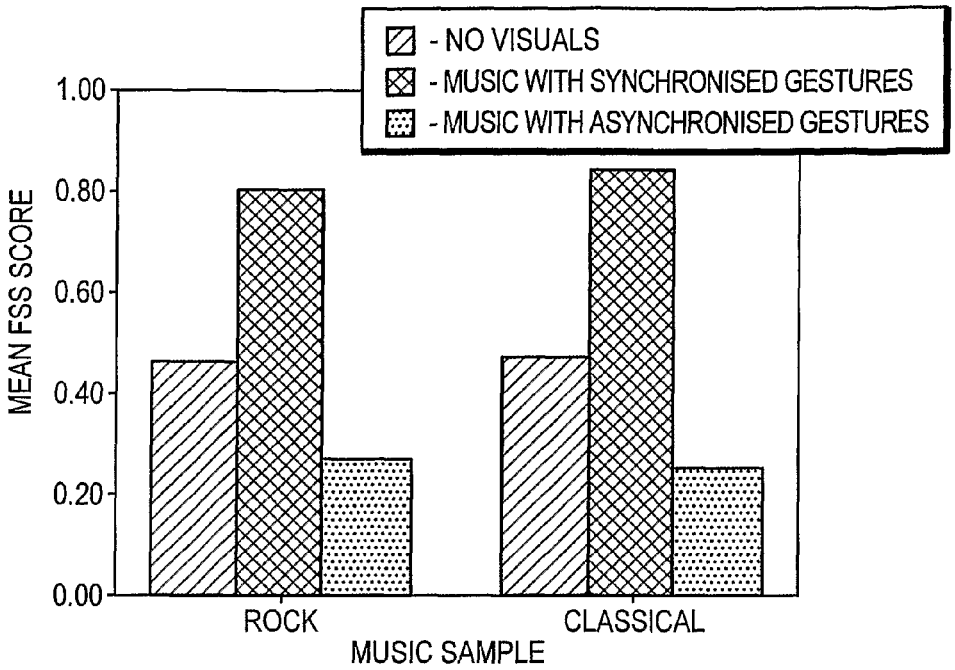
FIG. 9 is a graph of overall FSS scores comparing synchronized gestures versus asynchronized gestures in Exemplification III.
Figure 10:
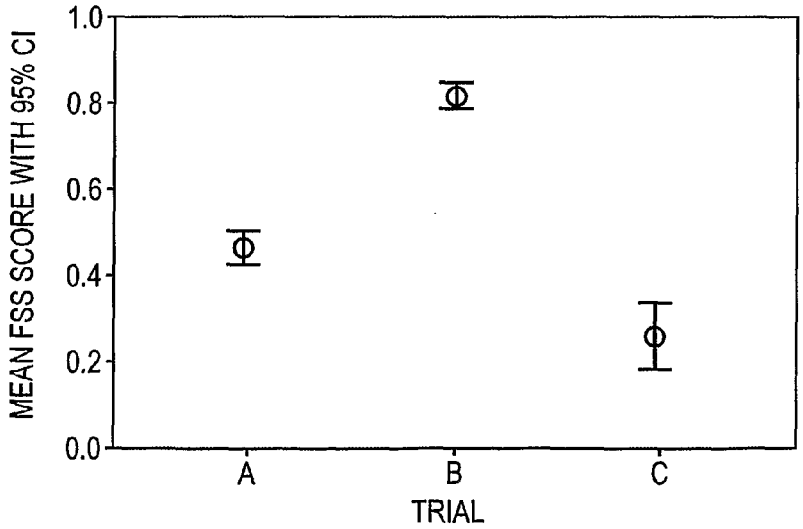
FIG. 10 is a plot of the mean FSS score for three different combinations of the test conditions used in FIG. 9 of Exemplification III.

FIG. 9 shows the overall results across all experimental conditions. As might be expected, music with synchronised gestures had the maximum score, music alone was the second best and music with asynchronised gestures had the lowest FSS score. A 2-way repeated measures of ANOVA ($F_{obs}<1$) suggested that the type of music (classical or rock) did not significantly affect the FSS score. Therefore, the FSS score was averaged across the different music samples and compared using one way ANOVA. The results are shown in FIG. 10.

One way ANOVA analysis confirmed that the mode of "seeing music" has a significant effect on the reported level of enjoyment ($F_{obs}$122.35, $p<0.01$). Tukey's HSD test was used to compare the means. The outcome of this test was as follows:

Mean FSS score of music with synchronised gestures (Trial B) was significantly higher ($p<0.01$) than music alone (Trial A) and had the best outcome.

Mean FSS score of music with synchronised gestures (Trial B) was significantly higher ($p<0.01$) than music with asynchronised gestures (Trial C).

Mean FSS score of music alone (Trial A) was significantly higher ($p<0.01$) than music with asynchronised gestures (Trial C).

Observations: Many participants said the visuals are wrong, when they listened to music with asynchronised gestures. Only one participant could not tell the difference between synchronised and asynchronised gestures for the rock song (the "ba" "ba" movements). She could still differentiate between synchronised and asynchronised gestures for the classical music (the orchestral conductor's gestures). Following are some comments received after watching the asynchronised gestures:

"This is wrong."

"I can't understand this."

"I'd rather listen to music alone".

"Doesn't make sense."

All the participants preferred to watch human body movements (e.g., video recorded or other images thereof) synchronised with music. When asked the reason for this, some of the participants said they could "hear" better; however, they were unable to clarify this further. From the statistical analysis given in the previous section and from the observations above, it appeared that most participants preferred watching human gestures synchronised with music when listening to music. When the music and gestures were asynchronised, the participants preferred just listening to music without any visual display.

Continuous Monitoring of Response to Haptic Chair

Although the feedback about the Haptic Chair 31 was uniformly positive, it is possible that what we were measuring was due to novelty rather than anything specific about listening to music hapticaly. Therefore, the objective of this experiment was to further explore the validity of the 100% positive feedback received for the initial prototype of the Haptic Chair 31. If the positive feedback was not due to initial excitement of a novel technology, then the user response should continue to be positive even after they use the Haptic Chair 31 for a longer period of time. To study this effect, the user satisfaction of the Haptic Chair 31 was monitored over a period of 3 weeks.

The ISO 9241-11 defines satisfaction as "freedom from discomfort and positive attitudes to the use of the product". Satisfaction can be specified and measured by subjective ratings on scales such as discomfort experienced, liking for the product and many other methods of evaluating user satisfaction. In this work, satisfaction was measured using a questionnaire derived from the "Usefulness, Satisfaction, and Ease of use" (USE) questionnaire (see A. M. Lund, "Measuring Usability with the USE Questionnaire," vol. 3. STC Usability SIG Newsletter, 2001). The modified USE questionnaire consisted of five statements where the participants were asked to rate a statement (of modified USE) on a 5 point scale, ranging from 1 (strongly disagree) to 5 (strongly agree). Overall satisfaction was calculated as a weighted average of the ratings given for the questions, and ranged from 0 to 1 where a score of 1 corresponded to optimal satisfaction.

Participants and Procedure

Six hearing-impaired participants (3 male, 3 female) took part in this study. They were randomly chosen from the 36 participants who took part in the user study described above. The idea of this experiment was to continuously monitor the user's satisfaction with the Haptic Chair 31. Each participant was given 10 minutes to listen to music while sitting on the Haptic Chair. They were allowed to choose songs from a large collection of MP3 songs the included British rock songs, Sri Lankan Sinhalese songs and Indian Hindi songs. This procedure was repeated every day over a period of 22 days. Each day, after the sessions, participants were asked to comment on their experience. On days 1, 8, 15 and 22 (Monday of each week over 4 weeks), after 10 minutes of informal listening, each of the participants were given the chance to listen to 2 test music samples—Mendelssohn's Symphony No. 4 and "It's my life" by Bon Jovi (the same samples used in the previous experiment). After listening to 2 test music samples, they were asked to answer a few questions derived from the USE questionnaire. User satisfaction was calculated from the responses. In addition, their preferences for the test music samples were recorded.

Results

Figure 11:
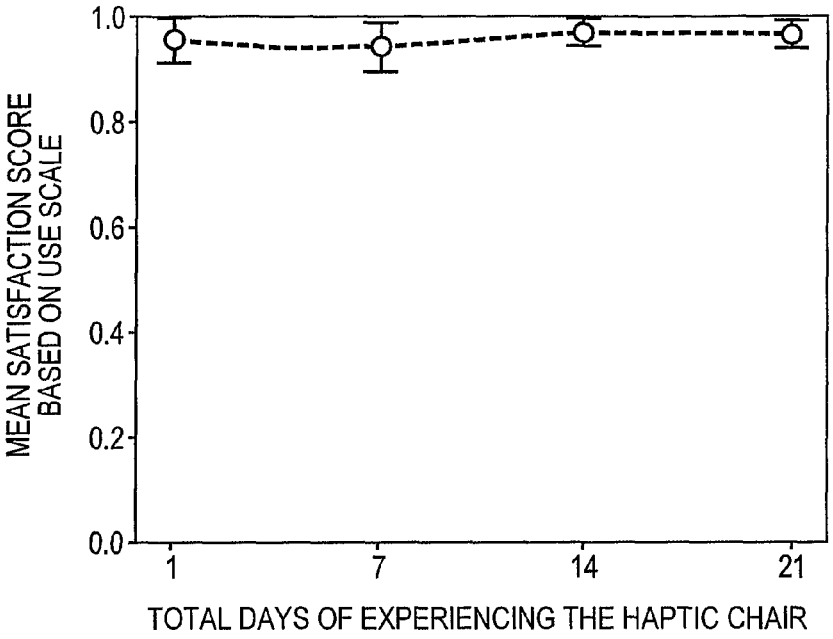
FIG. 11 is a plot of the mean USE (usefulness, satisfaction and ease of use) score of participants in Exemplification III.

It appeared that all six participants very much enjoyed the experience of the Haptic Chair. In fact, after two weeks of continuous use, all of them requested to increase the time (10 minutes) they were provided within a session. Therefore, the duration for each participant was increased and each participant was provided the opportunity to "listen" to music for 15 minutes per day during the last week of the study. FIG. 11 shows the overall satisfaction of the users measured on days 1, 8, and 22 (Monday of every week over 4 weeks) of the experiment. A Higher value for the USE score corresponds to higher satisfaction. As seen from FIG. 11, the participants were very satisfied with the Haptic Chair 31. Moreover, the satisfaction level was sustained over the entire duration of the experiment. One way ANOVA analysis confirmed that there was no significant difference in the observed level of satisfaction ($F_{obs}<1$). In other words, a participant's satisfaction with the Haptic Chair 31 remained unchanged even after using it 10 minutes every day for a period of more than 3 weeks. It was difficult to improve since the initial response was so positive.

Observations made: The participants' reactions to the Haptic Chair 31 were continuously monitored as a way of controlling for a possible novelty effect in our previous data. The level of enthusiasm was maintained throughout the extended experiment. There were times when some participants were unhappy when they were told that his/her session was over. After two weeks, the 6 participants were told that they did not have to come every day to take part in the experiment (to "listen" to music for 10 minutes) if they were not willing to. However, all the participants reported that they looked forward to the listening session. In fact, as mentioned in the previous section, all participants wanted to listen to music using the Haptic Chair 31 for a longer duration. None seemed to get bored with the Haptic Chair 31. Some of the important comments received were:

"I am really happy."

"This is very good."

"Actually, I like this."

"I feel like taking this home."

"Can I sit for 5 more mins?"

"10 mins is not enough."

"I couldn't hear the lyrics."

"So much better than listening to radio at home."

Since all the participants were making positive comments all the time and not criticising the Haptic Chair 31, they were specifically asked to make a negative comment. This was done on the $18^{th}$ day of the experiment. However, none of the participants made any negative comments other than reporting that they could not hear the lyrics.

On the sixteenth day of the experiment, one of the participants (a profoundly deaf student) was listening to music, a recording of a speech was played through the Haptic Chair 31 and he was asked whether he could hear the "Song". He reported that it was not a song!

Another important observation was made on the fifteenth day of the experiment. Usually, when the six participants came to use the Haptic Chair 31, one student sat on the chair and the rest sat by the laptop that was used to play the music. The music was played through the Windows Media player and apparently the Media Player visualisations were switched ON and visible on the computer screen. It was noticed that the students who were looking at the display were commenting about it to the sign language interpreter. According to the sign language interpreter, some of the comments of the students were:

"I feel sleepy."

"Looking at these patterns makes me dizzy."

"I am tired of looking at these."

Most of the participants were asking whether it is possible to play facial animations (that they had seen before during other experiments) with the songs.

Overall it appeared that everyone who used the Haptic Chair 31 liked the experience very much. This positive response was not due to the fact that it was a completely new experience for them. If it was due to initial excitement, the response would have gone down as they used the Haptic Chair for more than 3 weeks. The response at the end of the last day was as good as or even better than the response on the first day. On the last day of the experiment, when the participants were told that the experiment is over, one of them said I am going be deaf again thinking that she would not get the chance to experience the Haptic Chair 31 again.

The combination of human gestures synchronised with music was preferred by the participants over abstract patterns that changed corresponding to music. This could have been due to the presence of a human character. Silent dance can often be very entertaining. However, when the human gestures and music were not synchronised, almost all the participants spotted that and expressed their dislike. This shows that there is little to be gained by showing human gestures with music unless the gesturing patterns and music are tightly synchronised. The approach of using human gestures to convey a musical experience proved to be much more effective than abstract animations. With this modification the overall system 10 became more effective. Deaf people generally take many cues from watching other people move and react to sounds and music in the environment. This could be one explanation for strong preference observed for human gestures over abstract graphics. Brain imaging techniques may provide a stronger explanation for the preference of watching human gestures, though the approach was not within the scope of this research work.

Discussion

Unaltered Audio vs Frequency Scaled Audio

The Haptic Chair 31 described herein, deliberately makes no attempt to pre-process the music (audio 41) but delivers the entire audio stream to each of the separate vibration systems targeting the feet, back, arms, elbows and hands. In fact, any additional "information" delivered through the haptic channel might actually disrupt the musical experience, and this confounding effect is potentially more significant for the deaf. This is because deaf people have an extensive experience sensing through their bodies the vibrations that occur naturally in objects existing in an acoustic environment.

Most of the related works mentioned in the Background section pre-processed the audio signal before producing a tactile feedback, taking the frequency range of tactile sensation into account. Applicants conducted a preliminary study to compare the response to unaltered and frequency scaled music played through the Haptic Chair 31. In the case of frequency scaled music, the frequency range was scaled by a factor of 5. Although frequency scaling effectively generates low frequency vibrations (which might be more easily felt than higher frequency vibrations), the variations in the music were diminished and the richness of musical content was lower in the frequency scaled version. This could have been one reason for users/subjects disliking frequency scaled audio during a preliminary study. This reduction in quality is easily detected by people with normal hearing. It was important to note that even the hearing-impaired could still feel this effect through the Haptic Chair 31. Findings of this preliminary study further supported the design concept of not preprocessing the music in any way other than to amplify natural vibrations presented by music.

Detecting Multiple Vibrotactile Stimuli by Touch

The work by Karem et al. (M. Karam, F. A. Russo, C. Branje, E. Price, and D. Fels, "Towards a model human cochlea," in *Proc. Graphics Interface,* 2008, pp. 267-274), show that the emotional responses are stronger when different parts of the musical signal (separated by frequency regions or by instrumental part) are delivered through different vibration elements to different locations on a user's back. One explanation for the improved enjoyment is that there might be masking of some portion of the audio signal that is eliminated by the spatial separation of musical or frequency components. Another explanation has to do with the difference between the nature of the signals typically processed by the skin and the ear. Multiple sound sources excite overlapping regions of the cochlea, and the auditory brain has evolved to perform source segregation under such conditions, whereas multiple sources of tactile stimuli sensed through touch are typically represented by distinct spatial separation. One possible future study would be to determine whether multiple sources can be detected when delivered through a single channel of vibrotactile stimulation. If not, it would significantly enhance the musical information available to spatially segregate sources from each other.

Haptic Sensitivity vs Signal Complexity

The current study delivered the entire frequency range of the music through the Haptic Chair 31 as potential tactile stimulation, even though most studies report that a tactile system is only responsive up to approximately 1000 Hz. In addition to the strategic motivation of not manipulating the source signal for tactile music perception, Applicants believe that the role played by higher frequencies in tactile perception is still an open question as the frequency response curves reported in the literature have only been measured with sine tones. It is possible, however, that the role of higher frequencies in more realistic audio signals for instance, in creating sharp transients, could still be important. Applicants are currently exploring this issue. Another exciting possibility is that in addition to tactile sensory input, bone conduction might be providing an additional route for enhanced sensory input. Bone conduction of sound is likely to be very significant for people with certain hearing impairments and a far greater range of frequencies is transmitted via bone conduction of sound compared with purely tactile stimulation.

Speaker Listening vs Sensory Input Via Haptic Chair

The mechanism of providing a tactile sensation through the Haptic Chair 31 is quite similar to the common technique deaf people use called "speaker listening". In speaker listening, deaf people place their hands or foot directly on audio speakers to feel the vibrations. However, the Haptic Chair 31 provides a tactile stimulation to various parts of the body simultaneously in contrast to normal speaker listening where only one part of the body is stimulated at any particular instant. This is important since as mentioned above, feeling sound vibrations through different parts of the body plays an important role in perceiving music.

It is also possible that in addition to tactile sensory input, the Haptic Chair 31 might be providing an additional avenue for enhanced sensory input through bone conduction of sound. Bone conduction of sound is likely to be very significant for people with certain hearing impairments. Bone conduction also has the advantage of transmitting a greater range of frequencies of sound compared to purely tactile stimulation.

In these regards, the Haptic Chair 31 provides much more than simple speaker listening. The teachers at the deaf school where most of the user studies were conducted said that, as is typical of deaf listeners, some of the deaf participants place their hands on the normal audio speakers available at the school main auditorium and listen to music. Nevertheless, from the observations made throughout this research work, it appeared that even those who had already experienced speaker listening preferred to experience music while sitting on the Haptic Chair 31.

While this invention has been particularly shown and described with references to example embodiments thereof, it will be understood by those skilled in the art that various changes in form and details may be made therein without departing from the scope of the invention encompassed by the appended claims.

For example, embodiments of the system 10 can be modified to capture specific ambient warnings and alerts (such as a boiling kettle, phone rings, doorbell, etc.). This prevents the safety of the deaf user from being compromised while he is enjoying his favorite music. This feature of the haptic chair/invention system 10 alerts the user to any common everyday warnings/alerts that require his attention.

In another example, the present invention topic has considerable potential in the area of speech therapy. During the first formal user study, one of the sign language interpreters (a qualified speech therapist) wanted to use the Haptic Chair 31 when training deaf people to speak. Upon conducting her speech therapy programme with and without the Haptic Chair, she expressed confidence that the Haptic Chair would be a valuable aid in this kind of learning. The Haptic Chair 31 was modified so that the user was able to hear/feel the vibrations produced by voice of the speech therapist and his/her own voice. With this modification, the Haptic Chair is currently being tested to enhance its effectiveness for speech therapy. The speech therapist is currently conducting her regular speech therapy program with 3 groups of students under 3 different conditions.

a. Haptic chair with no sound/vibration output b. Haptic chair with complete sound/vibration output c. Normal chair Each student's ability of speech is being assessed (before and after every two weeks). The preliminary improvements displayed by the deaf users indicate the possibility of significantly improving their competence in pronouncing words with the usage of embodiments of the present invention haptic chair system 10.

One of the limitations of experiencing music through the Haptic Chair was the fact that hearing-impaired people could not hear the exact lyrics of a song. One possible solution for this is to use Amplitude Modulated (AM) ultrasound. Staab et al. found that when speech signals are used to modulate the amplitude of an ultrasonic carrier signal, the result was clear perception of the speech stimuli and not a sense of high-frequency vibration. It is possible to use this technology to modulate a music signal using an ultrasonic carrier signal which might result in clear perception of lyrics in a song or simply music. This concept is currently being developed/tested and preliminary tests showed that hearing is possible via ultrasonic bone conduction. One profoundly deaf participant was able to differentiate AM music and speech. He preferred the sensation when music was presented through AM ultrasound over speech presented through AM ultrasound, could not explain what he heard but simple reported he preferred the "feeling" of music through AM ultrasound. These observations open up an entirely new field to explore.

With a microphone array, it is possible to localize a sound source. The invention system 10 can be modified to connect to the microphone array instead of connecting to a recorded multi-audio source. Multiple vibrating speakers can be rearranged and configured to indicate the direction of a sound source respective to the listener-user. This is useful for the hearing impaired in assisting them to judge the direction of a sound source which might be a warning of impending danger or required action on their part.

Another extension of the current display 21 is to incorporate more musical features. Current software can be modified to display high level musical features such as minor versus major keys, melodic contours and other qualitative aspects of subject music.

As mentioned previously, adding karaoke style lyrics to the visual display 21 (when applicable) and/or providing a set of headphones would make an improved (more effective) embodiment.

Embodiments of the invention system 10 could also be used as an aid in learning to play a musical instrument or to sing in tune.

Finally, Applicants also believe this technology might enhance the enjoyment of music for people with normal hearing and those with narrow sound frequency band drop-outs. The latter is a relatively common form of hearing loss that is often not severe enough to classify the person as deaf but might cause annoying interruptions in their enjoyment of music or conversation. The Haptic Chair 31/invention system 10 has the potential to bridge these gaps to support musical or other types of acoustic enjoyment for this community, as well.

At various stages of development of the invention system 10, Applicants had informal discussions with more than 15 normal hearing people who tried the Haptic Chair 31 and Applicants received positive feedback.

Although the forgoing description and discussions refer to particular make and models of component parts, it is understood that various equivalent or similar parts and/or configurations are suitable for implementing embodiments of the present invention. The above non-limiting examples are given for purposes of clarity in illustrating and not for limiting the present invention.

What is claimed is:

1. A sound enhancing device, comprising:

a chair;

an audio power amplification and control unit receiving, from an audio source, audio input formed of audio data with natural vibrations, the audio power amplification and control unit being coupled to at least one part of the chair; and one or more speakers coupled to the chair, the speakers receiving said audio input from the audio power amplification and control unit such that the speakers receive the audio data with natural vibrations from the audio source and generate corresponding sound vibrations, the speakers being coupled to the chair in a manner delivering the generated sound vibrations to body parts of a user seated in the chair, such that the user experiences the audio input as vibrations through sense of touch and as sound through bone conduction, enhancing user experience of the audio input, wherein the audio power amplification and control unit has user-adjustable controls and is coupled to the chair in a manner enabling the user to control intensity of the sound vibrations of said speakers and wherein the speakers are contact speakers that amplify the generated sound vibrations delivered to body parts of the user and felt by sense of touch and through bone conduction of sound by the user.

2. A sound enhancing device as claimed in claim 1 wherein the audio input is music, and the device provides enhanced musical sound experience to the user.

3. A sound enhancing device as claimed in claim 2 wherein the user is hearing impaired.

4. A sound enhancing device as claimed in claim 1 wherein the audio input is any of: a real-time stream of audio data and a recorded stream of audio data.

5. A sound enhancing device as claimed in claim 1 wherein the speakers are coupled to the chair in a manner delivering the generated sound vibrations to any combination of: feet, hands, arms and back of the user.

6. A sound enhancing device as claimed in claim 5 wherein the chair has arms, and the chair arms further comprise dome areas delivering the generated sound vibrations to hands and fingers of the user.

7. A sound enhancing device as claimed in claim 1 further comprising a visual display corresponding to the audio input and being informative of features of the audio input.

8. A sound enhancing device as claimed in claim 7 wherein the features of the audio input include any one or combination of: amplitude, note onset, pitch, instrument change, rhythm, beats and musical key change.

9. A sound enhancing device as claimed in claim 7 wherein the visual display includes any combination of text, color-based indications of respective features of the audio input, variance in visual brightness as a function of amplitude of the audio input, three dimensional patterns and human gestures.

10. A sound enhancing device as claimed in claim 9 wherein one or more elements of the visual display are user adjustable.

11. A method of enhancing sound for a user comprising:

providing a chair;

an audio power amplification and control unit receiving, from an audio source, audio input formed of audio data with natural vibrations, the audio power amplification and control unit being coupled to at least one part of the chair; and coupling one or more speakers to the chair, the speakers receiving said audio input from the audio power amplification and control unit such that the speakers receive the audio data with natural vibrations from the audio source and generate corresponding sound vibrations, the speakers being coupled to the chair in a manner delivering the generated sound vibrations to body parts of a user seated in the chair, such that the user experiences the audio input as vibrations through sense of touch and as sound through bone conduction, enhancing user experience of the audio input is enhanced, wherein the audio power amplification and control unit has user-adjustable controls and is coupled to the chair in a manner enabling the user to control intensity of the sound vibrations of said speakers and wherein the speakers are contact speakers that amplify the generated sound vibrations delivered to body parts of the user and felt by sense of touch and through bone conduction of sound by the user.

12. The method claimed in claim 11, wherein the audio input is music, and the device provides enhanced musical sound experience to the user.

13. The method as claimed in claim 12 wherein the user is hearing impaired.

14. The method as claimed in claim 11 wherein the audio input is any of: a realtime stream of audio data and a recorded stream of audio data.

15. The method as claimed in claim 11 wherein the speakers are coupled to the chair in a manner delivering the generated sound vibrations to any combination of: feet, hands, arms and back of the user.

16. The method as claimed in claim 15 wherein the chair has arms, and the chair arms further comprise dome areas delivering the generated sound vibrations to hands and fingers of the user.

17. The method as claimed in claim 11 further comprising a visual display corresponding to the audio input and being informative of features of the audio input.

18. The method as claimed in claim 17 wherein the features of the audio input include amplitude, rhythm and/or beats.

19. The method as claimed in claim 17 wherein the visual display includes any combination of text, color-based indications of respective features of the audio input, variance in visual brightness based on respective amplitude of the audio input, three dimensional patterns and human gestures.

20. A haptic chair comprising:

a back rest;

chair arms;

a seat;

a foot rest;

an audio power amplification and control unit receiving, from an audio source, audio input formed of audio data with natural vibrations, the audio power amplification and control unit being coupled to at least one part of the chair; and a plurality of speakers coupled to any combination of the back rest, chair arms and foot rest, the speakers receiving said audio input from the audio power amplification and control unit such that the speakers receive the audio data with natural vibrations from the audio source and generate corresponding sound vibrations, the speakers being coupled to the back rest, chair arms and foot rest in a manner delivering the generated sound vibrations to body parts of a user seated in the seat, such that the user experiences the audio input as vibrations through sense of touch and as sound through bone conduction, enhancing user experience of the audio input, wherein the audio power amplification and control unit has user-adjustable controls and is coupled to the chair in a manner enabling the user to control intensity of the sound vibrations of said speakers and wherein the speakers are contact speakers that amplify the generated sound vibrations delivered to body parts of the user and felt by sense of touch and through bone conduction of sound by the user.

21. A sound enhancing system comprising:

an audio source;

an audio power amplification and control unit receiving, from the audio source, audio input formed of audio data with natural vibrations, the audio power amplification and control unit being coupled to at least one part of a chair;

a haptic chair formed of the chair and plural speakers mounted to the chair, the speakers receiving said audio input from the audio power amplification and control unit such that the speakers receive the audio data with natural vibrations from the audio source and generate corresponding sound vibrations, the chair being configured to deliver the generated sound vibrations to various body parts of a user seated in the chair in a manner enabling the user to experience the audio input as vibrations through sense of touch and as sound by bone conduction, wherein the audio power amplification and control unit has user-adjustable controls and is coupled to the chair in a manner enabling the user to control intensity of the sound vibrations of said speakers and wherein the speakers are contact speakers that amplify the generated sound vibrations delivered to body parts of the user and felt by sense of touch and through bone conduction of sound by the user; and a visual display viewable by the user, the display corresponding to the generated sound vibrations and being indicative of the corresponding audio input such that user experience of the audio input is enhanced by any one or combination of visually, by the sense of touch, and by bone conduction of sound.

* * * * *